US010612879B2

(12) United States Patent
Jacobson et al.

(10) Patent No.: US 10,612,879 B2
(45) Date of Patent: Apr. 7, 2020

(54) FIREARM MAINTENANCE KIT

(71) Applicant: Revo Brand Group, LLC, Plymouth, MN (US)

(72) Inventors: Ryan Jacobson, Minneapolis, MN (US); Matt Morris, Minneapolis, MN (US); James Hofman, Eden Prairie, MN (US)

(73) Assignee: Revo Brand Group, LLC, Plymouth, MN (US)

( * ) Notice: Subject to any disclaimer, the term of this patent is extended or adjusted under 35 U.S.C. 154(b) by 0 days.

(21) Appl. No.: 16/537,760

(22) Filed: Aug. 12, 2019

(65) Prior Publication Data

US 2020/0003518 A1 Jan. 2, 2020

Related U.S. Application Data

(63) Continuation-in-part of application No. 15/644,468, filed on Jul. 7, 2017, now Pat. No. 10,429,148.

(60) Provisional application No. 62/360,701, filed on Jul. 11, 2016.

(51) Int. Cl.
*F41A 29/00* (2006.01)

(52) U.S. Cl.
CPC ..... *F41A 29/00* (2013.01)

(58) Field of Classification Search
CPC ..... F41A 29/00
USPC ..... 428/99
See application file for complete search history.

(56) References Cited

U.S. PATENT DOCUMENTS

| | | | | |
|---|---|---|---|---|
| 5,785,219 | A | 7/1998 | Kraft | |
| D716,547 | S | 11/2014 | Pennington | |
| 2016/0059066 | A1 | 3/2016 | Willis | |
| 2017/0238733 | A1 * | 8/2017 | Saunier | A47G 9/062 |

OTHER PUBLICATIONS

"Napier Universal Air Gun Rifle Cleaning Mat Surface Protector Tool Kit Roll," eBay, http://www.ebay.co.uk/itm/Napier-Universal-Air-Gun-Rifle-Cleaning-Mat-Surface-Protector-Tool-Kit-Roll-/252577750482, Jun. 7, 2017, 6 pp.

"21-Piece Universal Handgun Cleaning Kit with Integrated TekMat Cleaning Mat," TekMat Gun Accessories, http://tekmat.com/gun-cleaning-kits, Jun. 7, 2017, 2 pp.

O'Hern, Brent T; Non-Final Office Action for Application No. 15/644,468; USPTO Communication; dated Jan. 9, 2019. 13 pp.

O'Hern, Brent T; Final Office Action for U.S. Appl. No. 15/644,468; USPTO Communication; dated Mar. 5, 2019. 9 pp.

O'Hern, Brent T; Non-Final Office Action for U.S. Appl. No. 15/644,468; USPTO Communication; dated Apr. 18, 2019. 7 pp.

* cited by examiner

*Primary Examiner* — Brent T O'Hern

(74) *Attorney, Agent, or Firm* — Grumbles Law PLLC; Brittany Nanzig

(57) ABSTRACT

A firearm maintenance kit having a mat and a small-parts storage case, the mat and case being used during adjustment and maintenance of firearms. The mat may be permanently or removably attached to the small-parts storage case via a mat attachment component. The mat attachment component can clamp a first end of the mat between top and bottom faces to affix the mat to the small-parts storage case. The small-parts storage case may have a tray and a cover and can be used to contain small firearms parts and prevent them from being lost during firearm maintenance, building, and cleaning.

15 Claims, 19 Drawing Sheets

FIG. 16
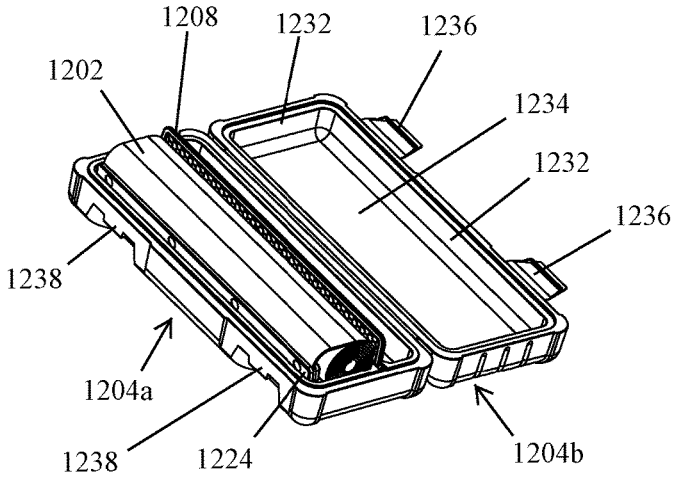
FIG. 17
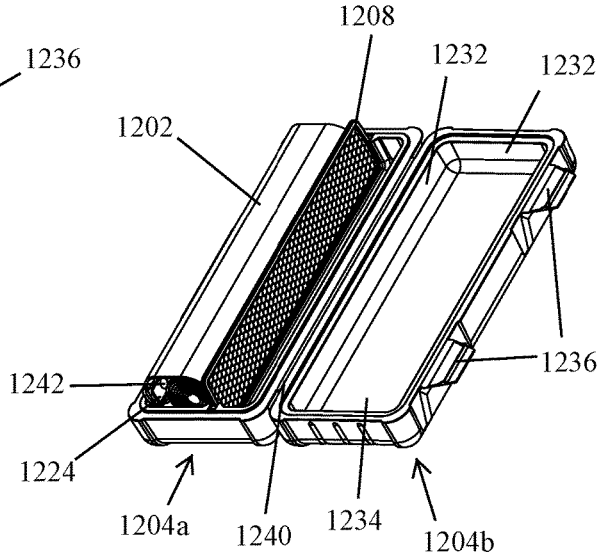
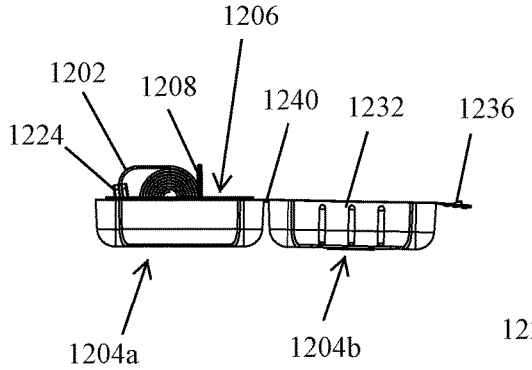
FIG. 18
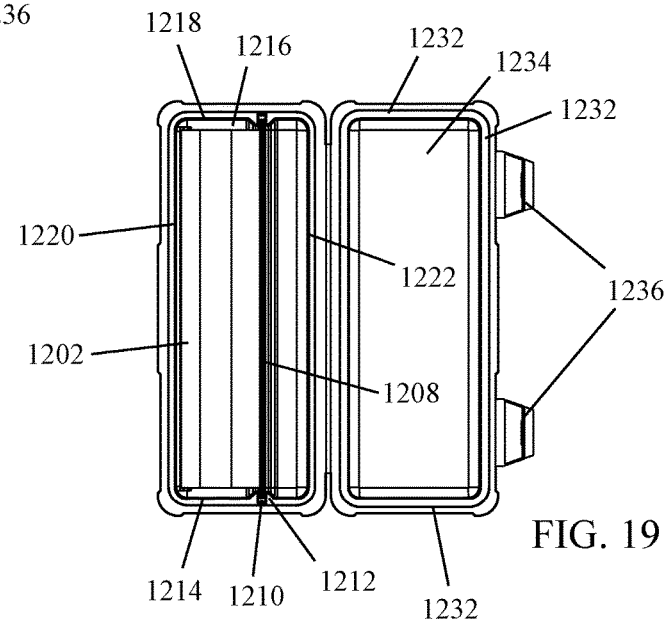
FIG. 19

FIREARM MAINTENANCE KIT

CROSS-REFERENCE TO RELATED APPLICATION

This application is a continuation-in-part of U.S. Non-provisional application Ser. No. 15/644,468 filed Jul. 7, 2017 and titled FIREARM CLEANING MAT, which claims the benefit of U.S. Provisional Application No. 62/360,701 filed Jul. 11, 2016 and titled FIREARM CLEANING MAT.

FIELD OF THE INVENTION

This disclosure relates to a kit used for firearm maintenance, building, and cleaning. More specifically, it relates to a flexible mat having an attached small-parts storage case, the mat and case configured to assist a user during adjustment, maintenance, building, and cleaning of firearms.

BACKGROUND OF THE INVENTION

After use and throughout their lives, firearms are affected primarily by carbon build-up. However, they are also affected by moisture, rust, and gunpowder residue. Therefore, firearms often need to be cleaned so they do not rust and decay. To accomplish this, individuals must take a firearm apart and clean each of the several firearm components. However, many of these components are small and can, therefore, be easily lost during cleaning. To date, some individuals will place the firearm on a designated mat in order to prevent the pieces from being scratched and to keep the pieces in a designated area. However, the small pieces, such as screws, pins, and washers can still easily be misplaced. Additionally, individuals may desire to replace certain firearm parts with other parts in order to repair a firearm or to build a custom firearm. Therefore, a firearm maintenance kit is needed that can protect the pieces from being scratched, that can prevent small pieces from being lost during firearm maintenance, building, and cleaning, and that can protect a table top surface from being damaged by cleaning solvents during cleaning.

SUMMARY OF THE INVENTION

The present disclosure relates to a firearm maintenance kit having a work surface, such as a mat, and a small-parts storage case. The mat can protect the firearm and the surface on which the firearm is placed from scratches and dents. In one embodiment, the work surface can be oil and/or solvent repellent. The small-parts storage case may include a mat attachment component comprising top and bottom faces, wherein the mat attachment component is structured and configured to clamp a first end of the mat between the top and bottom faces to affix the small-parts storage case to the mat. The small-parts storage case may further be comprised of a tray and a cover, wherein the tray and/or the cover can be used as a storage feature to contain small parts and prevent them from being lost during firearm maintenance, building, and cleaning. Further, the small-parts storage case can store the mat when it is no longer needed. A magnet can be included in the small-parts tray to retain small metal parts in at least a portion of the tray.

BRIEF DESCRIPTION OF THE DRAWINGS

FIG. 16 is a top perspective view of the firearm maintenance kit of FIG. 12 in an open and rolled up configuration.

FIG. 17 is a top perspective view of the firearm maintenance kit of FIG. 12 in an open and rolled up configuration.

FIG. 18 is a right side view of the firearm maintenance kit of FIG. 12 in an open and rolled up configuration; the left side view is a mirror image of the right side view.

FIG. 19 is a top view of the firearm maintenance kit of FIG. 12 in an open and rolled up configuration.

DETAILED DESCRIPTION

Figure 1:
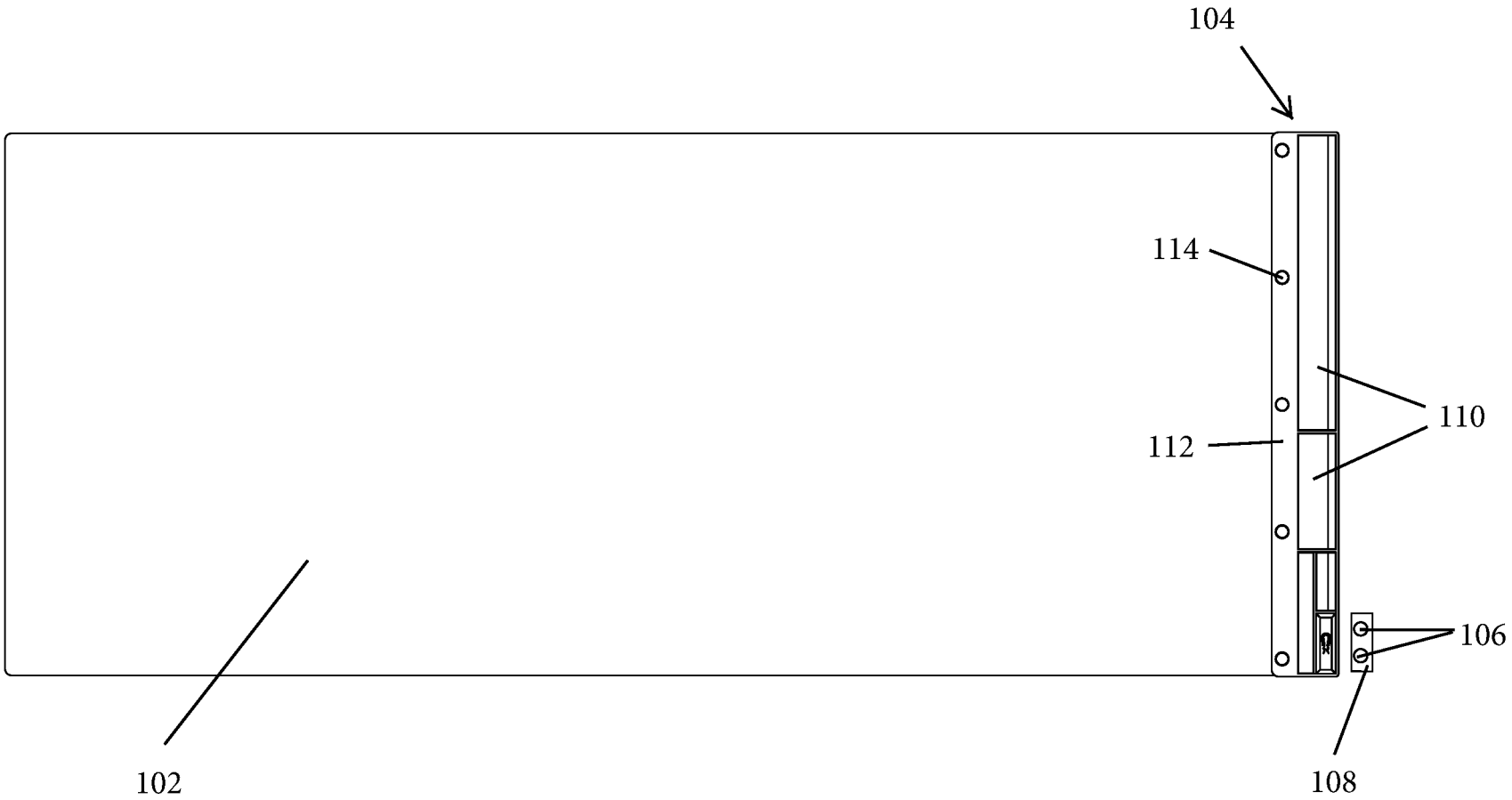
FIG. 1 is a top plan view of a firearm maintenance kit according to one embodiment of the present invention.

The present disclosure relates to a firearm maintenance kit that can be used to protect a firearm from scratches and dents when it is being cleaned. The disclosed firearm maintenance kit can also act as a storage feature to prevent small parts from being lost when the firearm is disassembled for cleaning. Various embodiments of the firearm maintenance kit will be described in detail with reference to the drawings, wherein like reference numerals represent like parts and assemblies throughout the several views. Reference to various embodiments does not limit the scope of the firearm maintenance kit disclosed herein. Additionally, any examples set forth in this specification are not intended to be limiting and merely set forth some of the many possible embodiments for the firearm maintenance kit. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Some embodiments of the firearm maintenance kit disclosed herein include features that are best suited for firearms maintenance and adjustment. The various components of the firearm maintenance kit help protect the surfaces of firearms pieces and components when the firearm is disassembled, allow users to store small pieces for safekeeping during disassembly, and store cleaning and maintenance tools that assist a user when disassembling and cleaning a firearm.

Figure 2:
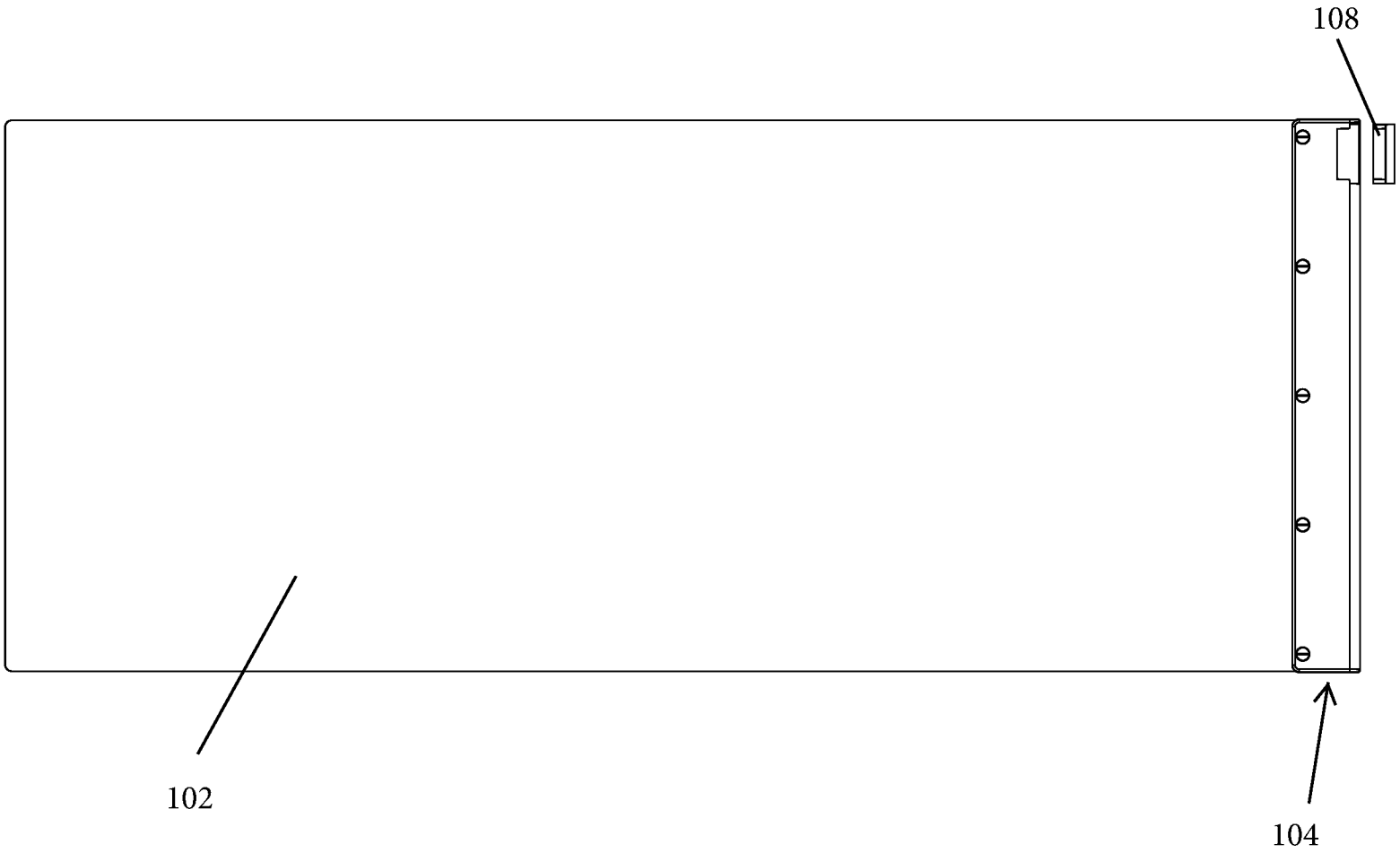
FIG. 2 is a bottom plan view of the firearm maintenance kit of FIG. 1.
Figure 3:
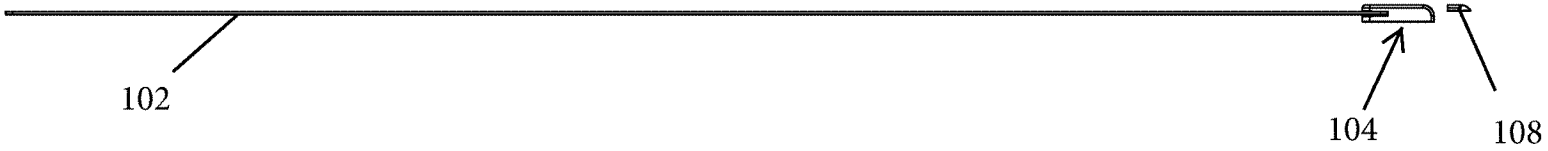
FIG. 3 is a back elevational view of the firearm maintenance kit of FIG. 1.
Figure 4:
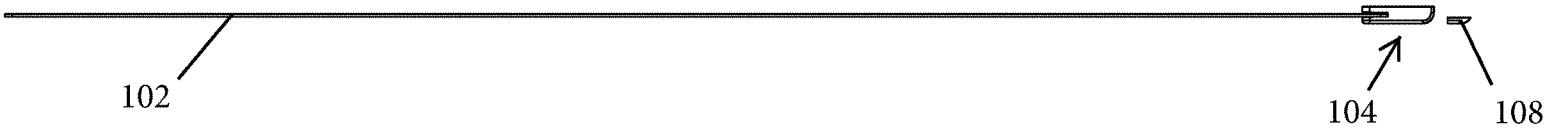
FIG. 4 is a front elevational view of the firearm maintenance kit of FIG. 1.
Figure 6:
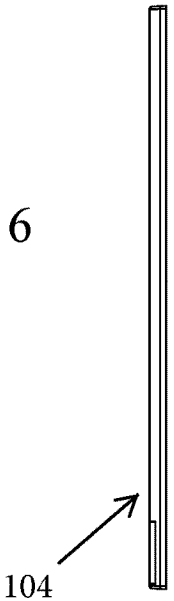
FIG. 6 is a right side view of the firearm maintenance kit of FIG. 1.
Figure 5:
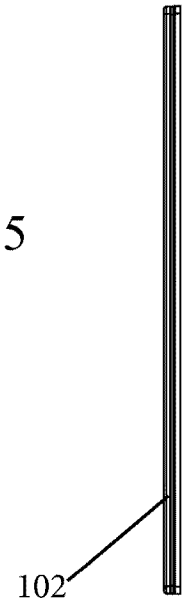
FIG. 5 is a left side view of the firearm maintenance kit of FIG. 1.
Figure 7:
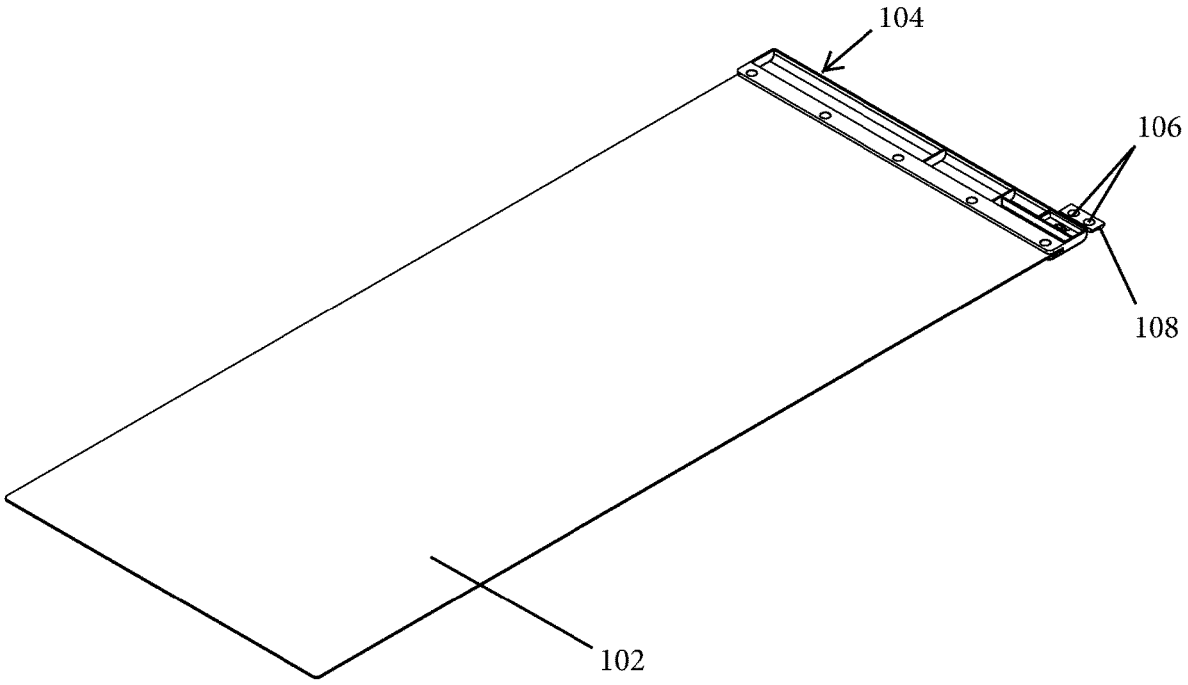
FIG. 7 is a top perspective view of the firearm maintenance kit of FIG. 1.
Figure 8:
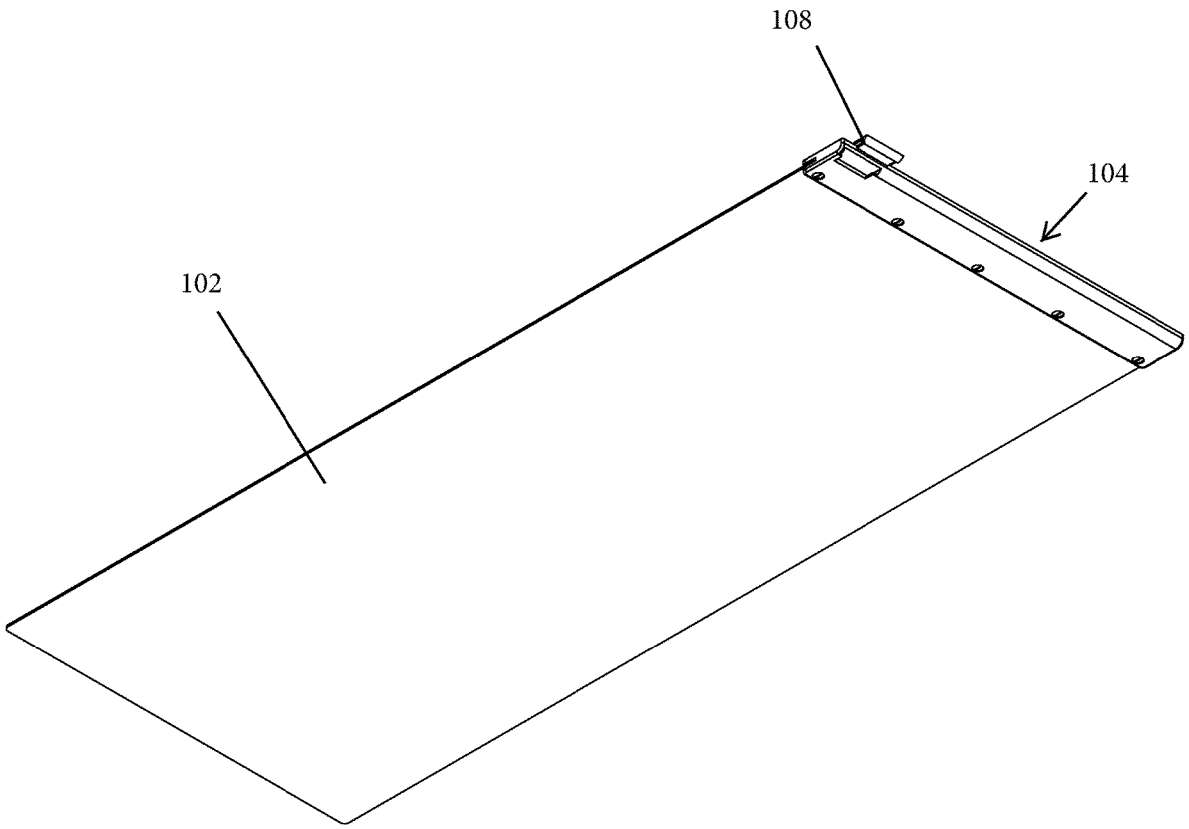
FIG. 8 is a bottom perspective view of the firearm maintenance kit of FIG. 1.
Figure 9:
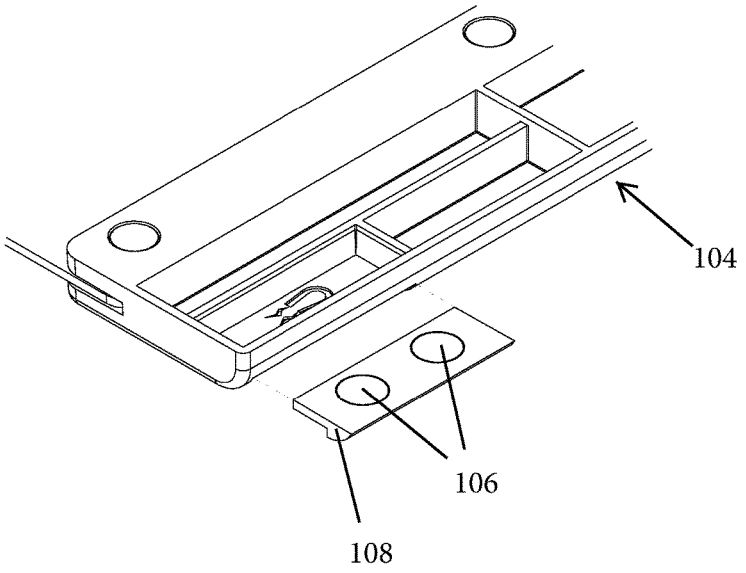
FIG. 9 is a top perspective view of a portion of a small-parts storage case that includes a drawer containing magnets.
Figure 10:
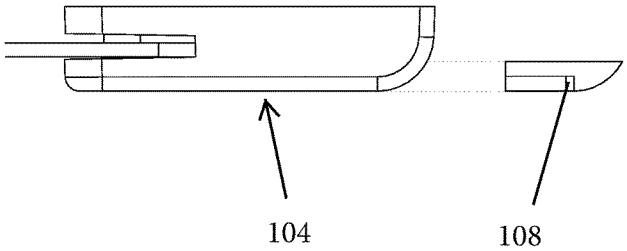
FIG. 10 is a front view of the small-parts storage case illustrating how the drawer containing the magnets fits into the small-parts storage case.
Figure 11:
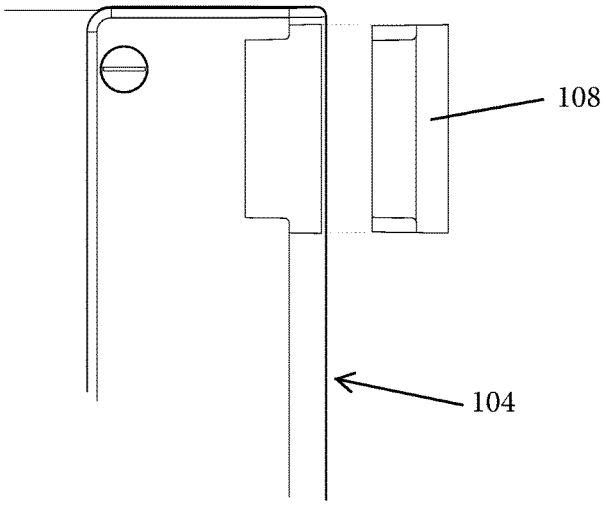
FIG. 11 is a bottom view of a portion of the small-parts storage case illustrating how the drawer containing the magnets fits into the small-parts storage case.

FIGS. 1-8 illustrate various views of an example of a firearm maintenance kit according to the present disclosure. FIG. 1 is a top plan view. FIG. 2 is a bottom plan view. FIG. 3 is a back elevational view. FIG. 4 is a front elevational view. FIG. 5 is a left side elevational view. FIG. 6 is a right side elevational view. FIG. 7 is a top perspective view. FIG. 8 is a bottom perspective view. FIGS. 9-11 illustrate how a magnet-containing drawer fits into a small-parts storage case of the firearm maintenance kit.

Figure 12:
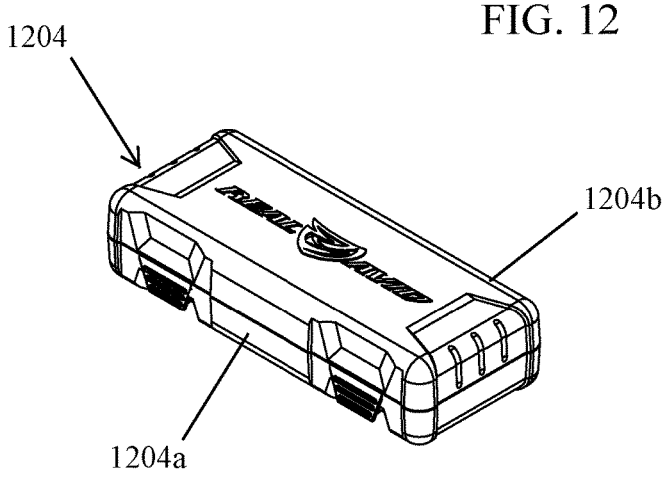
FIG. 12 is a top perspective view of a firearm maintenance kit in a closed configuration according to one embodiment of the present invention.
Figure 13:
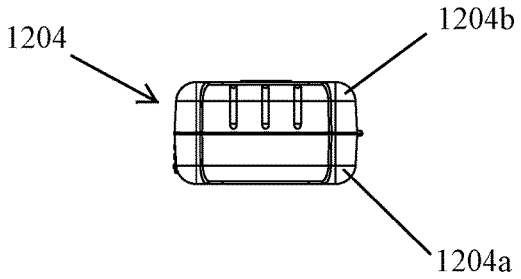
FIG. 13 is a right side view of the firearm maintenance kit of FIG. 12 in a closed configuration; the left side view is a mirror image of the right side view.
Figure 14:
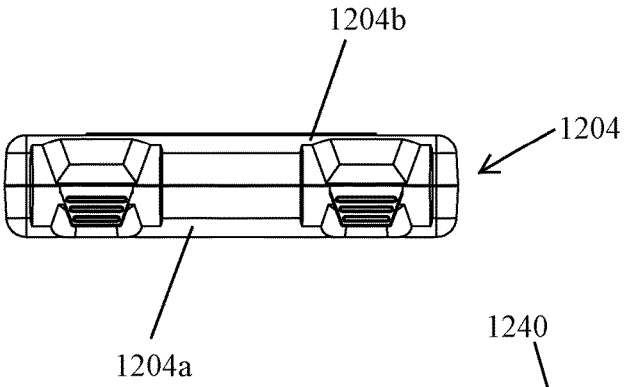
FIG. 14 is a front elevational view of the firearm maintenance kit of FIG. 12 in a closed configuration.
Figure 15:
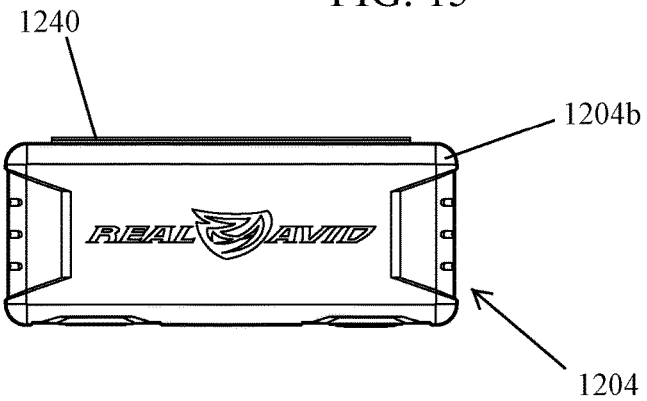
FIG. 15 is a top view of the firearm maintenance kit of FIG. 12 in a closed configuration.
Figure 25:
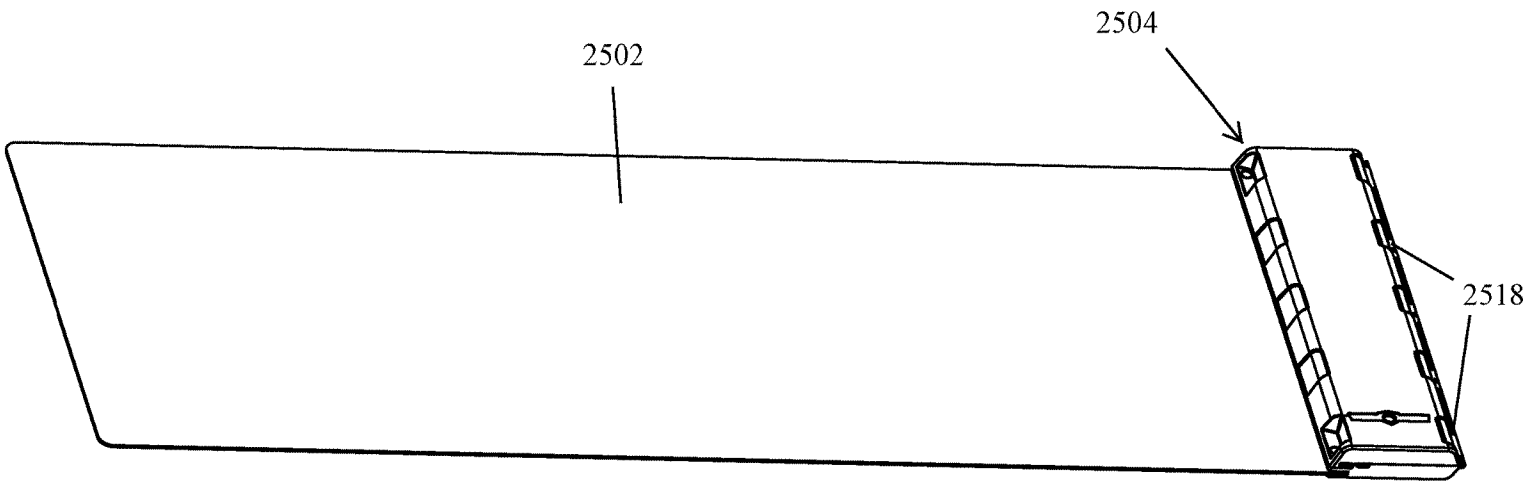
FIG. 25 is a top right perspective view of a firearm maintenance kit in a closed configuration according to one embodiment of the present invention.
Figure 26:
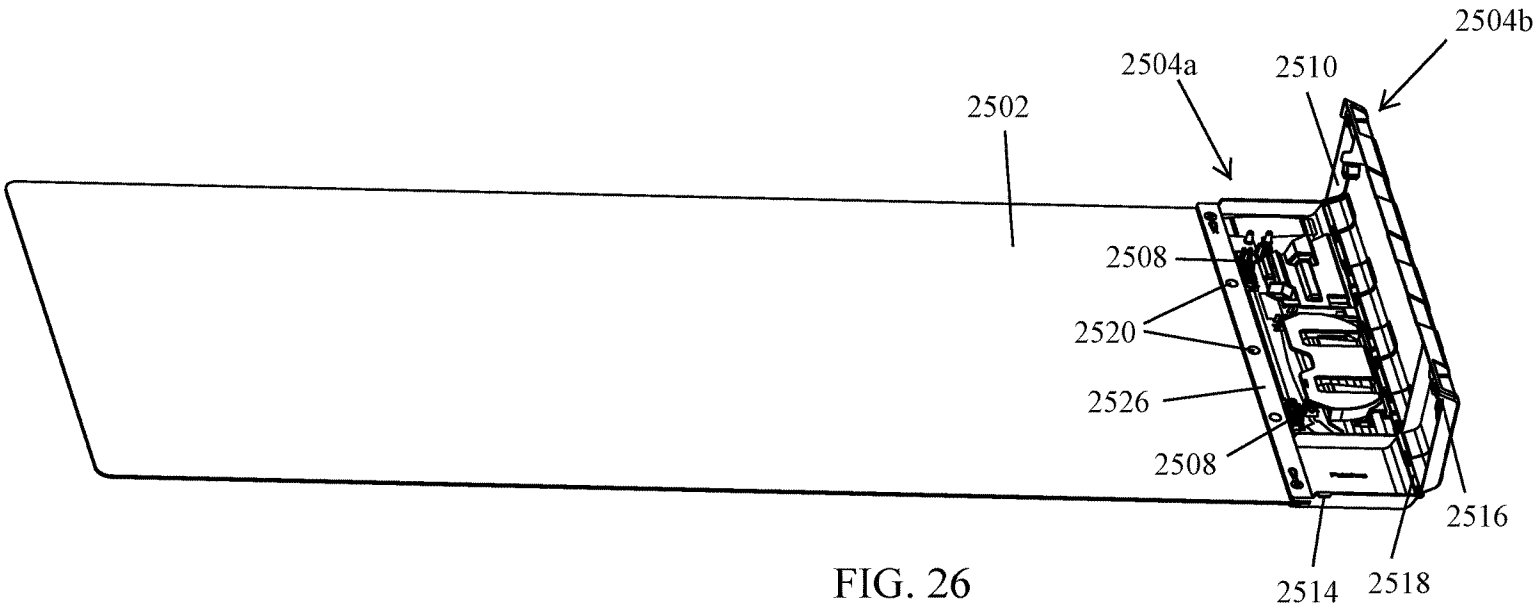
FIG. 26 is a top right perspective view of the firearm maintenance kit of FIG. 25 in a partially open configuration.
Figure 40:
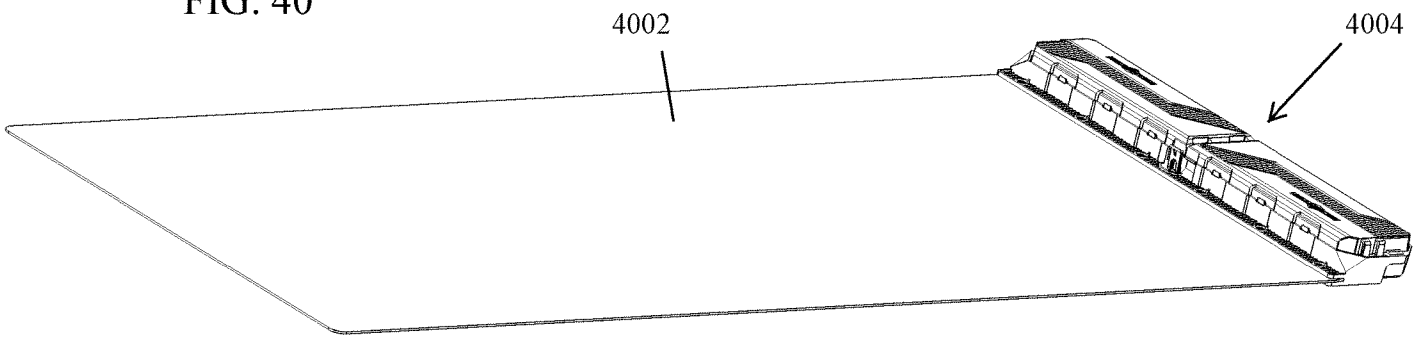
FIG. 40 is a top right perspective view of a firearm maintenance kit in a closed configuration according to one embodiment of the present invention.

Generally, the work surface of the firearm maintenance kit is relatively thin and flat, and the storage case can attach to one end of the work surface. More specifically, in some embodiments, as illustrated in FIGS. 1, 12, 25, and 40, the firearm maintenance kit can be comprised of a work surface, such as flexible mat 102/1202/2502/4002, small-parts storage case 104/1204/2504/4004 which can have tray 1204*a*/2504*a*/4004*a* and cover 1204*b*/2504*b*/4004*b*, as illustrated in FIGS. 12, 25, and 40, and magnet 106 in a portion of the tray, such as in or near drawer 108 or storage compartment 110. The flexible mat can be roughly rectangular but can take any other shape, such as, but not limited to, an oval, circle, triangle, square, or other polygon. The small-parts storage case can be located along the top or bottom of the flexible mat and along any edge. In some embodiments, the small-parts storage case can be positioned near one end of the flexible mat and can also be roughly rectangular. The flexible mat may be structured and configured to roll up on itself or around a small-parts storage case.

The mat can be made of any flexible material such that it can fold over on itself and roll up. For example, it can be comprised of a padded rubber material with a fabric layer adhered to a top surface of the padded rubber material. In some embodiments, the flexible mat can be made of neoprene with a coated fabric adhered to the top surface. The fabric on the top surface of the flexible mat may, in some embodiments, be an oil and/or solvent repellent. Alternatively, instead of a plurality of layers, the flexible mat may be comprised of one layer, and that layer can include an oil and/or solvent repellent. Further, the fabric, whether attached as a top layer or included as part of a single layer, may be water resistant.

The flexible mat can also be padded to protect the firearm and its components from scratches or dents if the firearm or its components are dropped on the mat during handling or aggressively maneuvered when positioned on the firearm cleaning mat. Additionally, because firearms are usually cleaned with solvents, the flexible mat can protect the surface on which it is placed, such as a tabletop, from exposure to oils, cleaning solvents, and damage from the firearm components.

In some embodiments, the flexible mat can provide step-by-step instructions that explain how to disassemble a firearm (for example, for cleaning). The step-by-step instructions may be illustrated on the surface of the flexible mat, and the illustrations may include images of specific firearm components that can be separated from each other. The instructions may also indicate in what order those components should be separated, and they may include writing in addition to the illustrations. In some embodiments, the writing can be printed firearm information or safety guidelines. In other embodiments, the writing can be a guide with steps that more specifically explain how the components can be separated from each other in order to disassemble the firearm for cleaning or other activity. In further embodiments, the illustrations on the flexible mat may be those of various firearm parts broken down. Each of the firearm part illustrations may be associated with a label, such as a designated number, that corresponds to labels in storage compartments of the small-parts storage case. This can enable a user to better remember what part of a firearm each of the small pieces and parts, such as pins, punches, springs, screws, bolts, washers, etc., are associated with once they are removed from the firearm.

In addition to the flexible mat, the firearm maintenance kit can have one or more small-parts storage cases 104/1204/2504/4004, as mentioned above, wherein the storage case can hold various small parts of a firearm and can enable a user to keep those small-parts separated and organized. In some embodiments, the firearm maintenance kit has one small-parts storage case located on one end of a flexible mat. More specifically, small-parts storage case 104 may be located on a short end of rectangular flexible mat 102, as illustrated in FIGS. 1-4 and 7-8, or on a long end of a rectangular flexible mat.

In other embodiments, the firearm maintenance kit may have a plurality of small-parts storage cases along one or more edges of the mat. For example, the firearm maintenance kit may have two small-parts storage cases along a long end of a rectangular flexible mat, thereby operating as one long, small-parts storage case. The two small-parts storage cases may be removable, thus enabling a user to have two, shorter small-parts storage cases that have space between them on one side of the flexible mat or that are on two different edges of the flexible mat (for example, a top and side edge, a bottom and side edge, two side edges, or a top and bottom edge). Any combination of small-parts storage cases and locations along the sides of the flexible mat is possible. However, in one embodiment, small-parts storage case 104 can be as long as, or slightly longer than, the side of flexible mat 102 to which it is attached, as illustrated in FIGS. 1-4 and 7-8.

Small-parts storage case 104 can be comprised of a tray, such as an open tray as illustrated in FIGS. 1-11, or of tray 1204*a*/2504*b*/4004*a* and cover 1204*b*/2504*b*/4004*b*, as illustrated in FIGS. 12-43, wherein the tray, the cover, or both can each have a plurality of compartments that can help a user keep the firearm's parts separate from each other or help keep the parts in specific groupings. Additionally, the tray, cover, or both can have compartments that store cleaning and/or disassembly tools.

In some embodiments, the compartments can be uniform in size. However, as illustrated in FIGS. 1 and 7, compartments 110 can be of various sizes. For example, there may be a longer or larger storage compartment for the largest tools, resources, or small parts, such as an instruction manual/field guide or a rod, and there may be one or more small storage compartments that help a user keep the smallest parts such as, but not limited to, small screws, pins, spacers, springs, washers, bolts, springs, etc. together or in specific groupings.

In one embodiment, the small-parts storage case 104 can have five compartments 110, wherein a first and a second compartment have the same width as the tray itself, a third, fourth, and fifth compartment are approximately half the width as the tray, the first compartment is approximately half the length of the tray, the second and third compartments are approximately one quarter the length of the tray, and the fourth and fifth compartments are approximately one eighth the length of the tray, as illustrated in FIG. 1. The outside row of compartments can have exterior radiused corners to make the removal of small parts from the firearm easier.

Figure 20A:
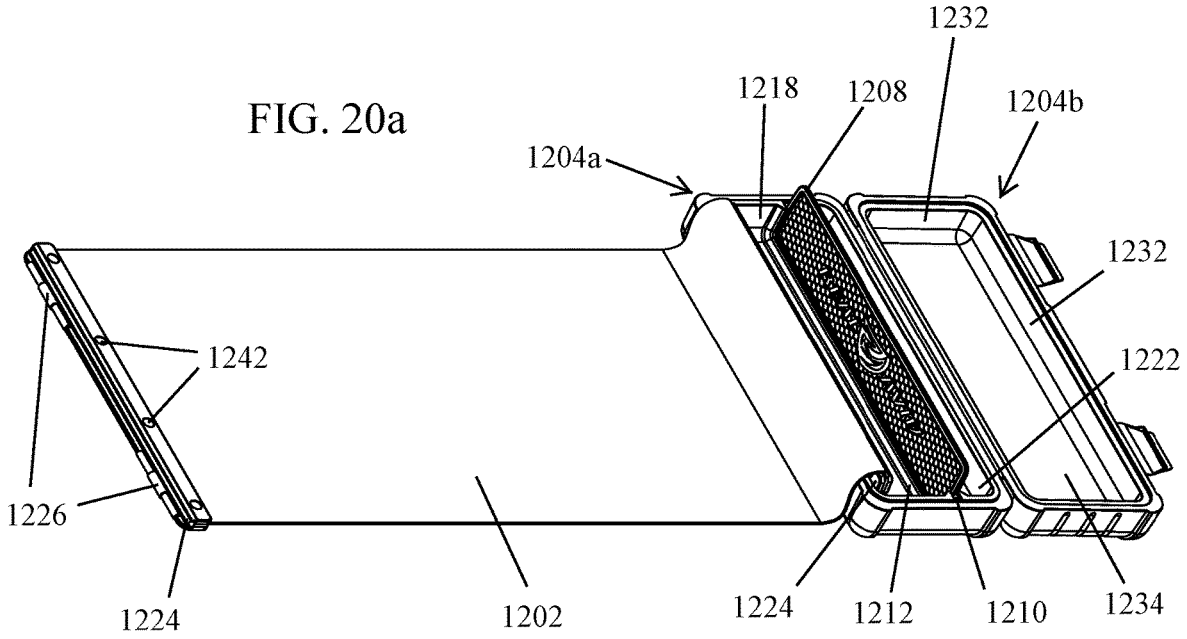
FIG. 20*a* is a top right side perspective view of the firearm maintenance kit of FIG. 12 in an open and unrolled configuration.
Figure 22:
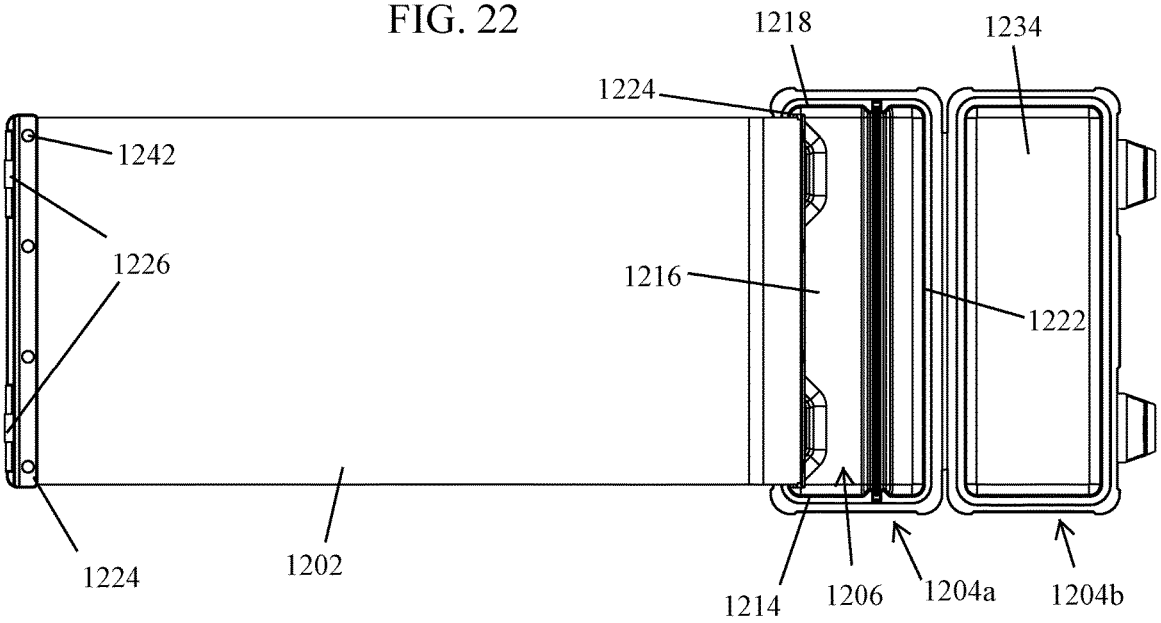
FIG. 22 is a top view of the firearm maintenance kit of FIG. 12 in an open and unrolled configuration.
Figure 23:
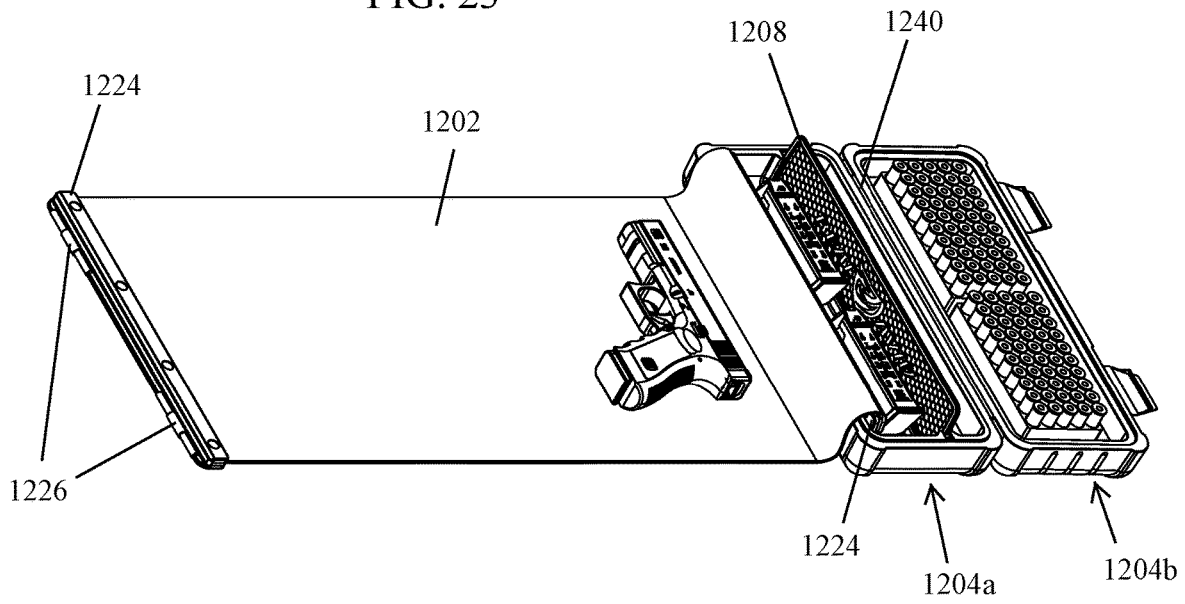
FIG. 23 is a top right side perspective view of the firearm maintenance kit of FIG. 12, wherein the mat and case are shown in use.
Figure 24:
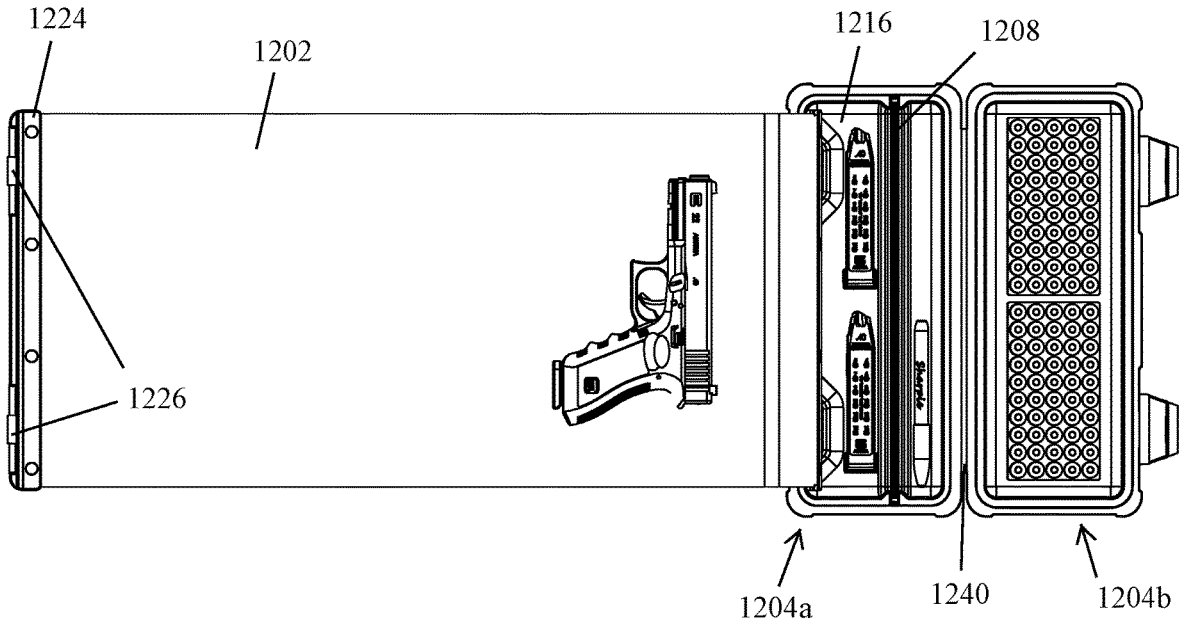
FIG. 24 is a top view of the firearm maintenance kit of FIG. 12, wherein the mat and case are shown in use.

In some embodiments, tray 1204*a* can be one large open cavity 1206 into which items can be loosely placed, as illustrated in FIGS. 12-24. To provide compartmentalized spaces, cavity 1206 may further include insert/rigid divider 1208 that separates the cavity into at least two storage compartments. To stay upright, divider 1208 may have a friction fit with two inner walls of tray 1204*a*, or it may be secured using a specific attachment means positioned on or in the tray. For example, divider 1208 may fit into gap/channel 1210 running from one end of the tray to the other, and the channel may be defined by raised lips 1212. More specifically, channel 1210, being defined by raised lips 1212, may start on an inner surface of raised front wall 1214 of tray 1204*a* and run along an inner surface of base 1216 of the tray to an inner surface of raised back wall 1218 of the tray, as illustrated in FIGS. 20*a*, 22, and 24. Similarly, channel 1210 may run from first raised side wall 1220 of tray 1204*a* through base 1216 of the tray and to second raised side wall 1222 of the tray. Therefore, to create compartmentalized spaces, a user can take rigid divider 1208 and slide it into channel 1210, wherein the channel can have a slightly larger width compared to the width of the divider.

Figure 27:
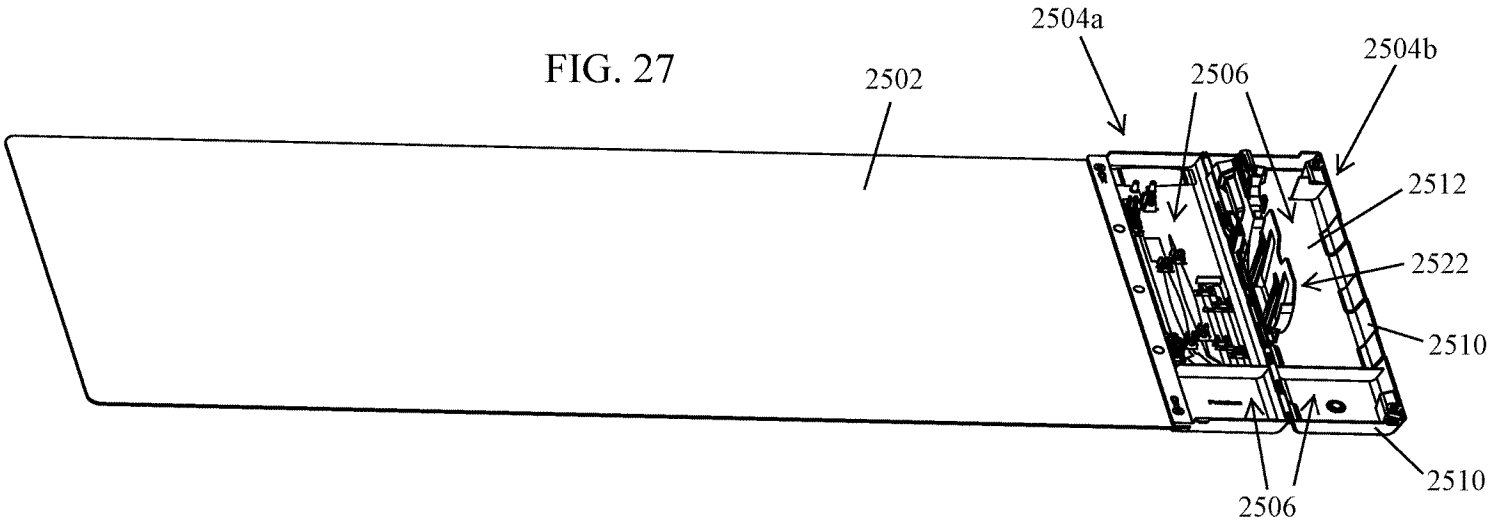
FIG. 27 is a top right perspective view of the firearm maintenance kit of FIG. 25 in an open configuration.
Figure 32:
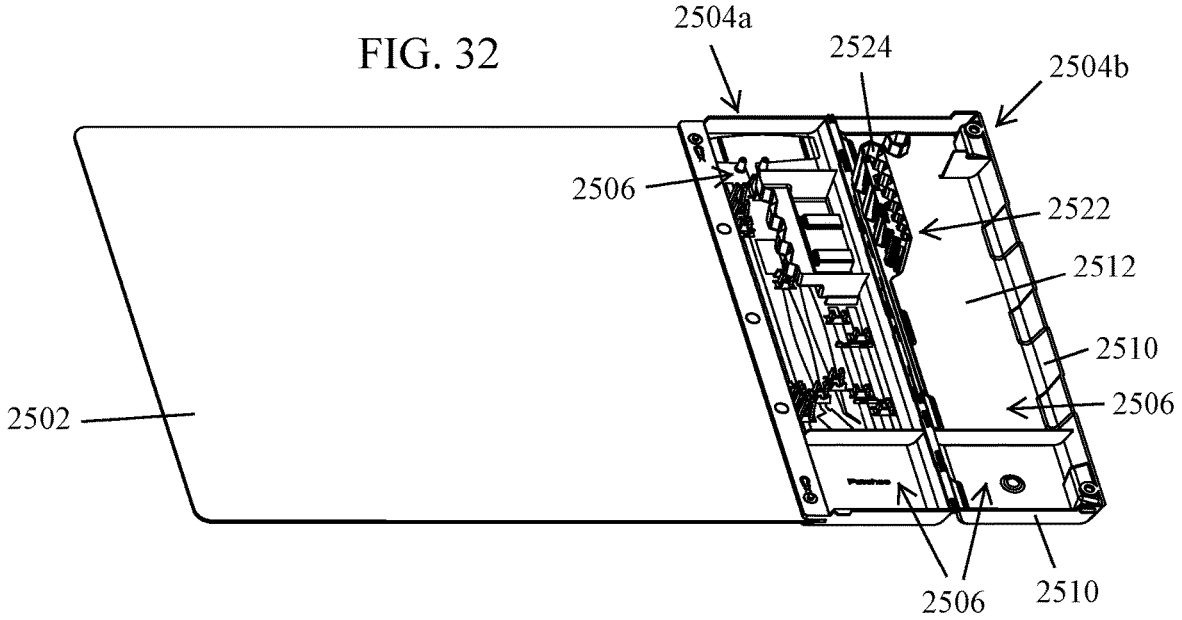
FIG. 32 is a top right perspective view of the firearm maintenance kit of FIG. 30 in an open configuration.
Figure 37:
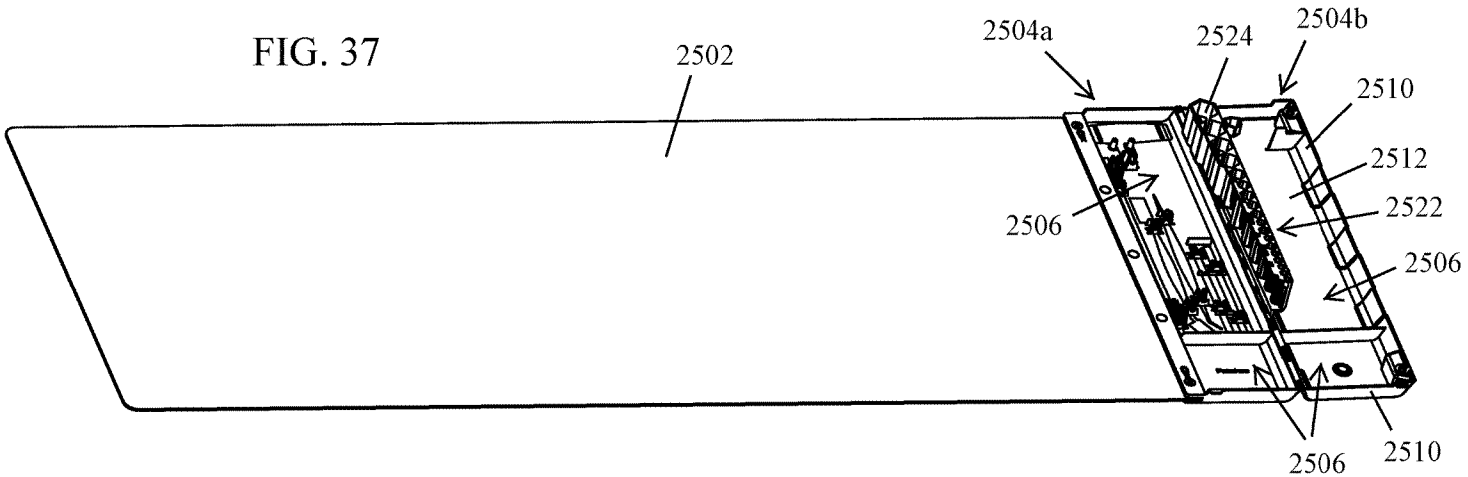
FIG. 37 is a top right perspective view of the firearm maintenance kit of FIG. 35 in an open configuration.
Figure 41:
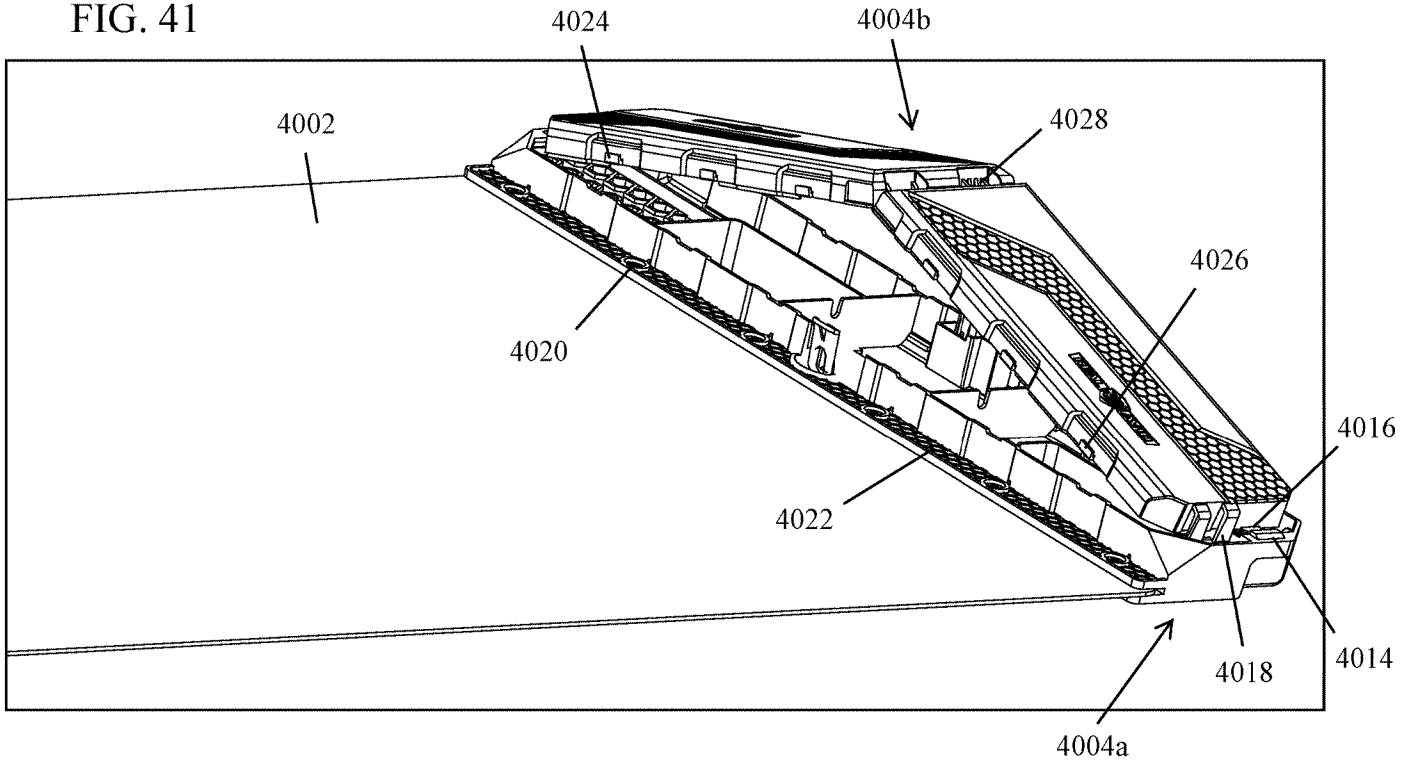
FIG. 41 is a top right perspective view of the firearm maintenance kit of FIG. 40 in a partially open configuration.
Figure 42:
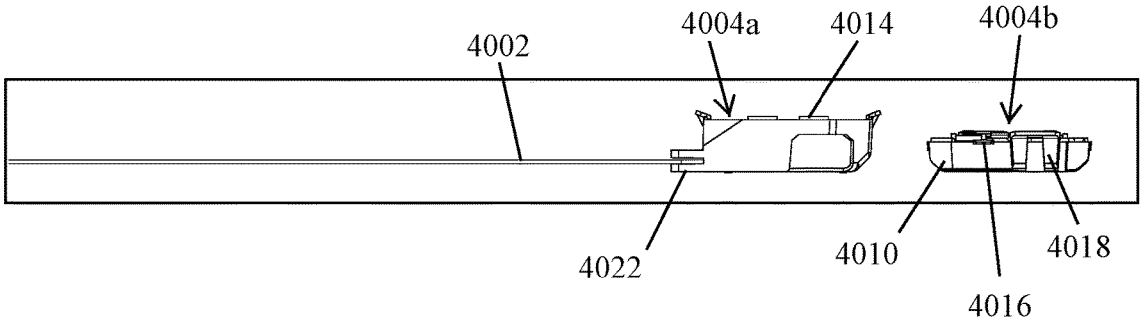
FIG. 42 is a right side view of the firearm maintenance kit of FIG. 40 in an open configuration; the left side view is a mirror image of the right side view.
Figure 43:
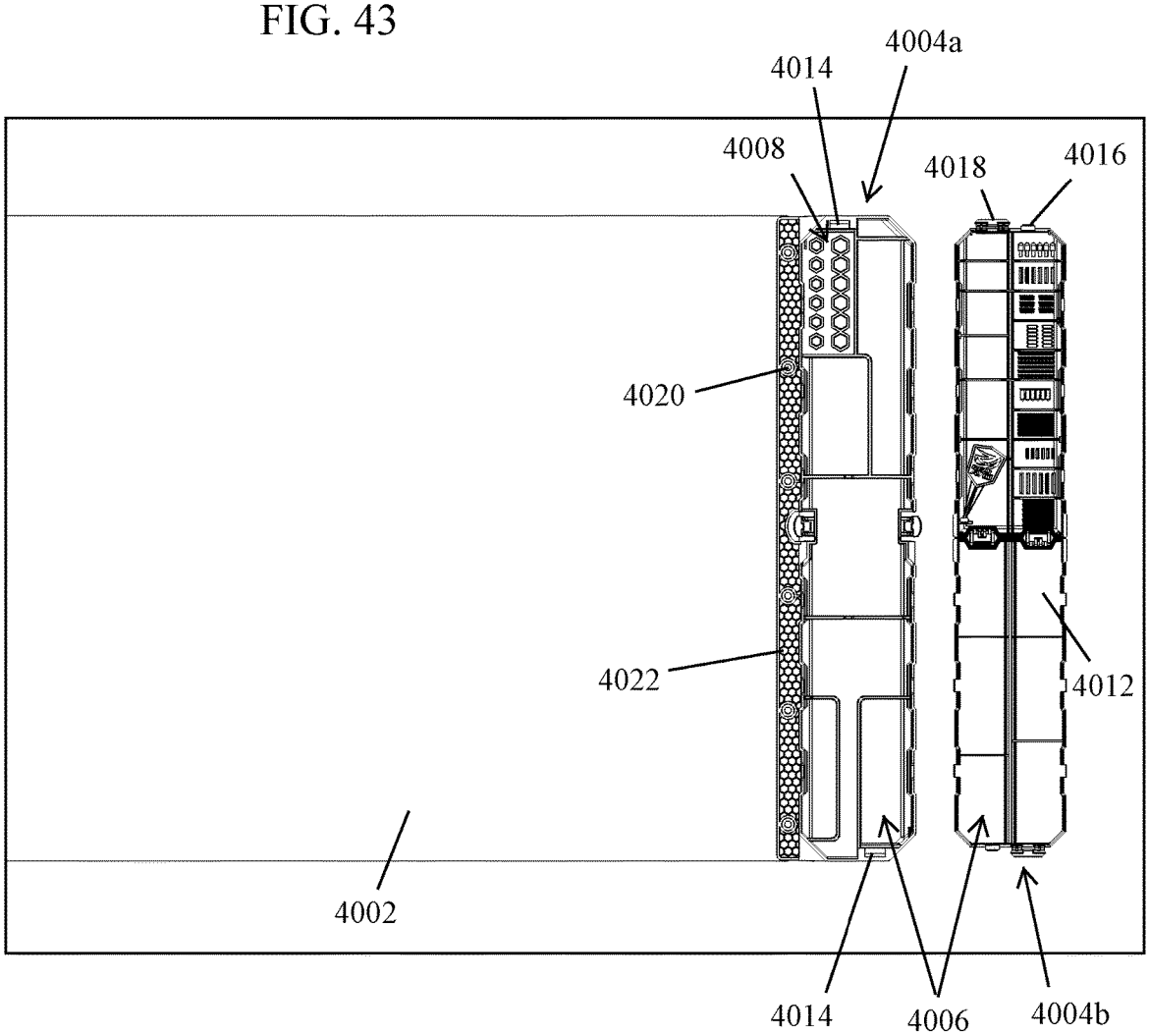
FIG. 43 is a top view of the firearm maintenance kit of FIG. 40 in an open configuration.

In some embodiments, tray 2504*a*/4004*a* of small-parts storage case 2504/4004 can primarily store tools and other resources that can benefit users during assembly, disassembly, or other use of their firearm, as illustrated in FIGS. 25-43. More specifically, tray 2504*a*/4004*a* may include: open storage compartments 2506/4006, as described above; various friction fit tabs 2508 within which the elongate main body of specific rigid tools and pieces can fit and be held in place (for example, a tool having an elongate, rigid body and a tool head can lock into place via a snap fit), as illustrated in FIGS. 27, 32, and 37; friction fit storage compartments 4008, as illustrated in FIGS. 41 and 43 (for example, molded storage components that may be hollow so that tools or small parts can be held in place using a friction or pressure fit); other attachment means by which tools and pieces can attach to the tray; or combinations thereof.

In some embodiments, the small-parts storage case can be made of any rigid material such that the small-parts storage case retains its shape under mechanical pressure and cannot be easily bent or folded. The rigid material can include, but is not limited to, plastic, aluminum, steel, wood, carbon fiber, other materials, or combinations of these. In some embodiments, the small-parts storage case can be injection molded using ABS resin.

In some embodiments, the small-parts storage case, or a portion of it, can be magnetic. This enables the small, metal pieces from the firearm that are placed within the small-parts storage case to remain contained within the case even if the flexible mat or case are bumped or shifted. For example, magnet 106 may be embedded within or attached to the surface of small-parts storage case 104, which may be metal. More specifically, magnet 106 may sit within one of the compartments of small-parts storage case 104, it may be embedded and encompassed within the small-parts storage case so that it is not visible, or it may be embedded in the small-parts storage case with one or more of its faces still exposed (for example, the magnet can be embedded on the underside of the case).

In one embodiment, the magnet can fit inside a drawer that slides into, and attaches to, the small-parts storage case. In some embodiments, the small-parts storage case, in its entirety, is magnetic. In other embodiments, the magnet may only affect a portion of the small-parts storage case so that only a designated portion of the case is magnetic. The magnet may be any type of magnet, such as a vinyl magnet with an adhesive backing that is placed in one of the compartments of the small-parts storage case. In some embodiments, the magnet can be a neodymium magnet. In another embodiment, the magnet can be a rare-earth magnet, and the small-parts storage case can include two rare-earth magnets stored in a drawer below a compartment of the small-parts storage case. More specifically, as illustrated in FIGS. 9-11, magnets 106 can be embedded in drawer 108 that slides into the bottom of the small-parts storage case 104. Drawer 108 can be permanently affixed to small-parts storage case 104 or it can be removable. In this regard, magnets 106 may not be visible to a user.

In some embodiments, the firearm maintenance kit can include a mat attachment component having top and bottom faces, wherein the mat attachment component is structured and configured to clamp or pinch one end of the mat between the top and bottom faces of the mat attachment component, thus enabling the small-parts storage case to be affixed to the mat. More specifically, as illustrated in FIGS. 9-10, 20*b*, 21, 28, 33, 38, and 42, the mat attachment component can clamp one end of the mat by having a top of the mat in contact with the top face of the mat attachment component and a bottom of the mat in contact with a bottom face of the mat attachment component when the mat is unrolled.

For example, as illustrated in FIGS. 3-4, 9-10 and 25-43, the mat attachment component can be an extension from one edge of the small-parts storage case that attaches to the flexible mat by having one end of the mat clamped or pinched between the top and bottom faces of the attachment component of the small-parts storage case. For example, the flexible mat may be approximately rectangular in shape, therefore having two short edges and two long edges, and a short edge can be attached to the mat attachment component of the small-parts storage case. In this example, the mat attachment component can be referred to as a proximal tray edge, and the side of the tray opposite the proximal tray edge can be referred to as the distal tray edge.

Figure 20B:
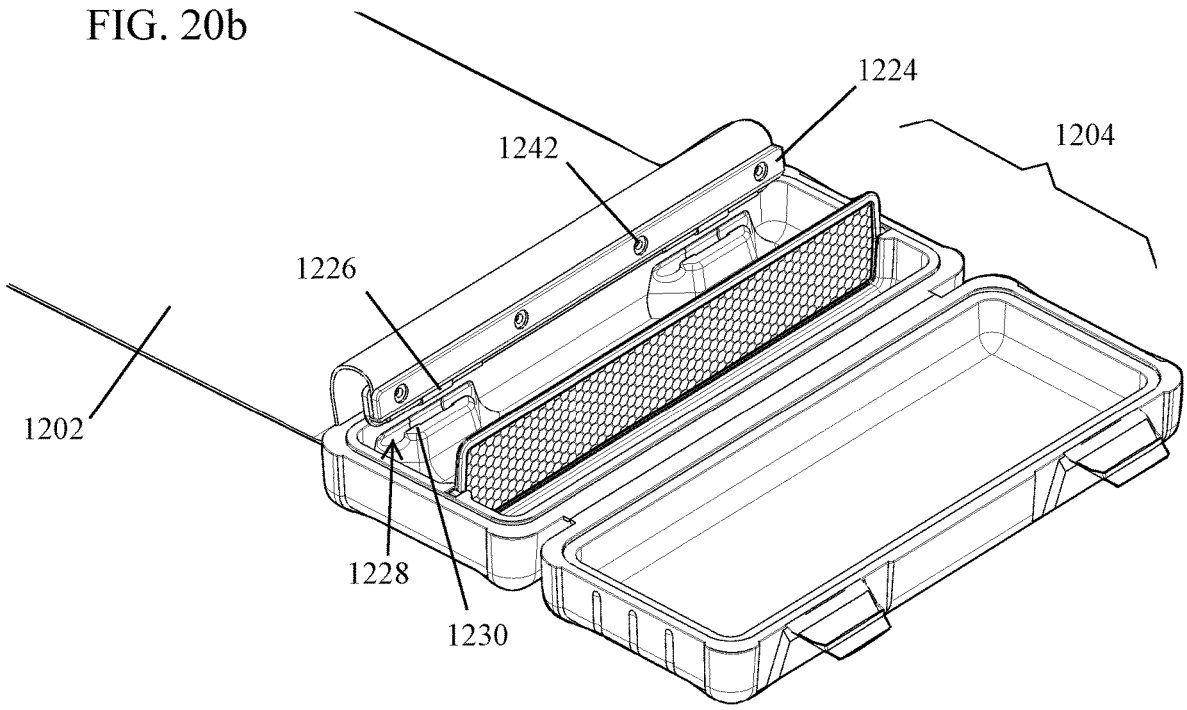
FIG. 20*b* illustrates the means by which a rigid component affixed to an edge of the mat can snap or slide into a corresponding groove in the case.
Figure 21:
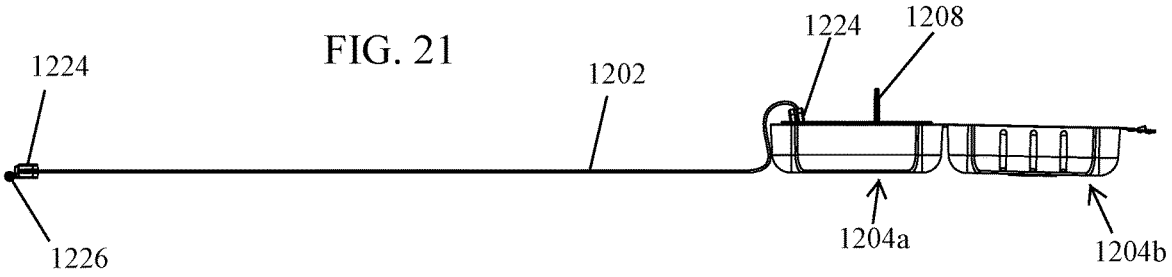
FIG. 21 is a right side view of the firearm maintenance kit of FIG. 12 in an open and unrolled configuration; the left side view is a mirror image of the right side view.

In some embodiments, the small-parts storage case can have a fastening component that attaches to the flexible mat. More specifically, instead of small-parts storage case 104/1204/2504/4004 attaching directly to flexible mat 102/1202/2502/4002, the firearm maintenance kit can include mat attachment component 112/1224/2526/4022 that can function to removably connect the mat to the small-parts storage case by pinching one end of the mat between top and bottom faces of the mat attachment component, as illustrated in FIGS. 18, 20*b*, 21, 28, 33, 38, and 41-42. In addition to top and bottom faces, mat attachment component 1224 can include rigid component 1226, which can be located adjacent to top and bottom faces, as illustrated in FIG. 20*b*.

In some embodiments, one end of the mat can be secured to mat attachment component 112/1224/2526/4022 in any of the previously-listed positions using fasteners, such as, but not limited to, bushing fasteners, rivets, glue, tape, an insert-mold, screws, or other general fasteners, which help to keep the small-parts storage case in place. In some embodiments, as illustrated in FIGS. 9, 17, 20*b*, 26, 31, 36, and 41, mat attachment component 112/1224/2526/4022 can secure to flexible mat 102/1202/2502/4002 using removable, threaded, bushing fasteners 114/1242/2520/4020. For example, mat attachment component 112/1224/2526/4022 may use several (for example, four to five) removable, threaded, bushing fasteners 114/1242/2520/4020 equally spaced apart to ensure flexible mat 102/1202/2502/4002 stays securely attached to the mat attachment component.

In some embodiments, the small-parts storage case can be fixed in a specific location along the mat. However, in other embodiments, the small-parts storage case and mat can be removably attached to each other. For example, the small-parts storage case and the mat may be separated and then the small-parts storage case relocated and secured along any other edge of the flexible mat. For example, as illustrated in FIG. 20*a*, flexible mat 1202 may include two mat attachment components 1224, one on each end of the mat, so that either side can be affixed to small-parts storage case 1204. Alternatively, the small-parts storage case and the mat may be separated and left in that configuration, leaving the mat and the case as separate, unattached components.

In some embodiments, one end of the flexible mat can attach to the small-parts storage case using a snap or friction fit. More specifically, mat attachment component 1224 may be permanently or removably affixed to an edge of flexible mat 1202 (for example, using fasteners 1242), and one or more rigid components 1226 of the mat attachment component can snap, slide, or otherwise attach to corresponding groove(s) 1228, as illustrated in FIG. 20*b*. Rigid component 1226 can be a rounded protrusion structured and configured to fit into corresponding groove 1228 to connect small-parts storage case 1204 to mat 1202, as illustrated in FIG. 20*b*. More specifically, rigid component 1226 may be roughly cylindrical and, as mentioned previously, located adjacent to the top and bottom faces of mat attachment component 1224, as illustrated in FIG. 20*b*. Groove 1228 may be a space defined by raised portions on an inside surface of small-parts storage case 1204. Further, the raised portions of small-parts storage case 1204 may define groove 1228 as a round cutout. The raised portions can include one or more flexible tabs 1230 that protrude into groove 1228, and the flexible tabs can be structured and configured to retain rigid component 1226 inside the groove. Further, flexible tabs 1230 can enable rigid component 1226 to rotate like a hinge without separating from the at least one groove 1228.

In some embodiments, mat attachment component 1224 may have two rigid components 1226, one on each end of the mat attachment component, as illustrated in FIGS. 20*a*-25. Additionally, as described above, firearm maintenance kit may include two mat attachment components 1224, one attached to each end of mat 1202. This can enable user to attach either end of flexible mat 1202 to small-parts storage case 1204 and can assist with rolling up the flexible mat for storage in the case by providing a rigid end piece about which the mat can roll or fold.

While, in some embodiments, the small-parts storage case can have an open-faced tray, as described above and illustrated in FIGS. 1-11, in other embodiments, case 1204/2504/4004 may additionally have cover 1204*b*/2504*b*/4004*b* that pairs with tray 1204*a*/2504*a*/4004*a*, as illustrated in FIGS. 12-43, wherein the cover can have a cavity defined by walls 1232/2510/4010 and a relatively flat, top face 1234/2512/4012, and the walls of the cover can mate with the tray, as described in more detail below. Tray 1204*a*/2504*a*/4004*a*, cover 1204*b*/2504*b*/4004*b*, or both can be rigid such that tray and cover retain their shape under mechanical pressure and cannot be easily bent or folded unless designed to bend along a hinge, as illustrated in FIG. 41. In some embodiments, both are made of plastic, and the cover can be clear so that a user can see what pieces or tools are stored in the case when it is closed. In some cases, the tray may also be clear.

In addition to the tray having compartments for storage, as described above, the cover can also operate as a storage feature. For example, as illustrated in FIGS. 23-24, cover

1204*b* may be a simple, open cavity that can hold one or more boxes of ammunition. In another example, as illustrated in FIGS. 27, 32, and 37, an inner surface of the cover's top face 2512 can be structured and configured such that the cover contains two or more storage compartments 2506, as illustrated in FIGS. 26-27, 29, 31-32, 34, 36-37, and 39, to keep small or easy-to-lose parts organized when the firearm is disassembled. Therefore, when a user wishes to expose the inside of small-parts storage case 2504, the user can flip cover 2504*b* over so the inner surface of top face 2512 of the cover is facing upward toward the user, and compartments 2506 are accessible to the user.

Compartments 2506 may be molded as part of cover 2504*b* or may otherwise be comprised of walls or containers that are connected to the inner surface of top face 2512. The removable or additional walls or containers can be structured and configured to securely attach to the inner surface of top face 2512 so they are prevented from separating when cover 2504*b* is closed onto tray 2504*a*.

The cover may be structured and configured to be permanently or removably attached to the tray of the small-parts storage case. For example, the cover may be attached to the tray of the small-parts storage case via a hinge, which may have an inner portion contained between the tray and the cover. Further, the hinge may enable the small-parts storage case to rotate and transition from a closed position to an open position and back. More specifically, one cover wall 1232/2510 can be permanently affixed to tray 1204*a*/2504*a* via hinge 1240/2518. This would enable the user to grip the non-hinged side of cover 1204*b*/2504*b* and rotate the cover 180 degrees so that it lays open. Cover 1204*b*/2504*b* can be affixed and hinged to tray 1204*a*/2504*a* on an edge of the tray that runs parallel to and on the opposite site of flexible mat 1202/2502, as illustrated in FIGS. 16-39, but could also be affixed and hinged on any other edge of the tray. Therefore, in one embodiment, flexible mat 1202/2502 can be attached via mat attachment component 1224/2526 and/or one or more fasteners 1242/2520 to a proximal edge of tray 1204*a*/2504*a*, and cover 1204*b*/2504*b* can be attached via one or more hinges 1240/2518 to a distal edge of the tray. Alternatively, the cover may removably attach to the tray by securing each edge on its open-faced end to the tray using a snap or friction fit.

To keep the cover attached to the tray when access to the case is not needed, a series of attachment points along one edge of the small-parts storage case can enable the case to maintain its closed configuration. Generally, the edge of the cover opposite the attached edge can be secured to the tray using attachment points such as, but not limited to, magnets, snaps, latches, or any other securing means. These attachment points can hold the cover to the tray of the case, thereby preventing the cover from flopping open. For example, cover 1204*b* can include attachment points 1236, such as locking clasps, that mate with corresponding attachment points 1238, such as tabs, on tray 1204*a* to securely and reversibly lock case 1204. In other embodiments, tray 2504*a* can include one or more attachment points 2514, such as hooks, that mate with corresponding attachment points 2516 (for example, by inserting and latching onto gaps) on cover 2504*b* to securely and reversible lock case 2504. Insert FIG. 40 locking/latching discussion here.

In embodiments where the cover may removably attach to the tray by securing each edge on its open-faced end to the tray, tray 4004*a* and cover 4004*b* can each have attachment points by which they connect to each other, as illustrated in FIGS. 40-43. More specifically, tray 4004*a* can have one or more tray attachment points 4014 onto which corresponding first cover attachment points 4016 of cover 4004*b* can connect, as illustrated in FIG. 41. Cover 4004*b* may also include one or more second cover attachment points 4018 that can latch onto tray 4004*a*. In some embodiments, opposing ends of tray 4004*a* may each have one tray attachment point 4014 and opposing ends of cover 4004*b* may each have one first cover attachment point 4016 and one second cover attachment point 4018. Tray attachment point 4014 and first cover attachment point 4016 can align and join together to lock cover 4004*b* to tray 4004*a*.

Further, side edges of tray 4004*a* that are situated between the opposing ends may also have attachment features. For example, side edges of tray 4004*a* may include one or more first half cover latches 4024 and one or more second half cover latches 4026, as illustrated in FIG. 41. Each side edge may, in some cases, include first half and second half cover latches 4024, 4026. First half cover latch(es) 4024 may be located on a first half of each side edge and second half cover latch(es) 4026 may be located on a different, second half of each side edge. These latches 4024, 4026 may be the same or different from each other, and they may be structured and configured to mate with each other when the cover 4004*b* is folded in half, as described in more detail below. In some embodiments, cover 4004*b* may include three first half cover latches 4024 on each side edge and three second half cover latches 4026 on each side edge, as illustrated in FIG. 43.

In some embodiments, cover 4004*b* may itself function as an independent storage unit once removed from tray 4004*a*. For example, cover 4004*b* may include open storage compartments 4006, a first cover attachment point 4016 on each end, a second cover attachment point 4018 on each end that connects to the first cover attachment points when the cover is folded in half, first half cover latches 4024 along both side edges, second half cover latches 4026 along both side edges that connect to the first half cover latches when the cover is folded in half, and hinge 4028, which may be a living hinge located along a mid-point of the cover and along which the cover can be folded in half. FIG. 41 illustrates cover 4004*b* in the process of folding in half. Cover attachment points 4016, 4018 and cover latches 4024, 4026 may all be snap tabs.

In some embodiments, the tray may have one or more attachment points, such as magnets, embedded or otherwise secured along one edge (for example, the edge of the tray connecting to the mat), and the cover may have corresponding attachment points placed along a tray-facing top surface of the wall. Therefore, if the tray's attachment points (for example, tray magnets) are placed on a proximal edge of the tray, the cover's attachment points (for example, cover magnets) can be placed on a proximal edge of the cover, wherein the proximal edge of the cover rotates away from the mat when the user opens the cover.

In addition to tray and cover compartments 2506, small-parts storage case 2504 may include further tool or parts storage, such as an insert stored within the small-parts storage case. More specifically, the insert may be pop-up insert 2522, which can be stored within the small-parts storage case and located between small-parts storage tray 2504*a* and cover 2504*b*. In some embodiments, pop-up insert 2522 can be attached to small-parts storage tray 2504*a* between the tray and cover 2504*b*. For example, pop-up insert 2522 may attach to an inner portion of hinge 2518, as illustrated in FIGS. 27, 32, and 37. Pop-up insert 2522 can store cleaning tools such as, but not limited to, brushes, scrapers, and field guides. More specifically, pop-up insert 2522 can include molded storage components 2524 that may be hollow so that the cleaning tools can be held in place using a friction or pressure fit. For example, one or more of storage compartments 2524 in insert 2522 can be hollow and can accept one end of a cleaning tool.

Figure 28:
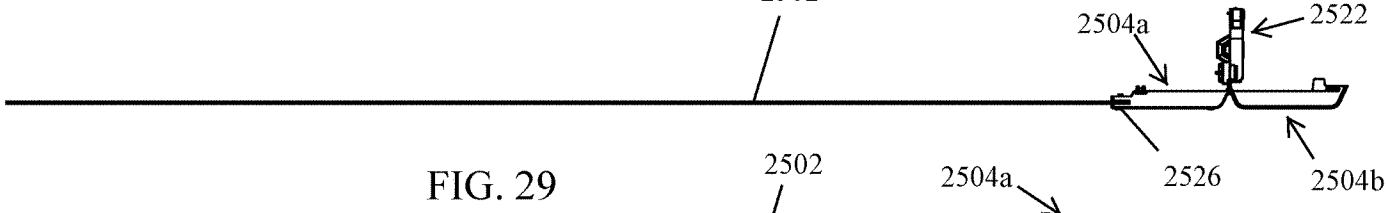
FIG. 28 is a right side view of the firearm maintenance kit of FIG. 25 in an open configuration; the left side view is a mirror image of the right side view.
Figure 29:
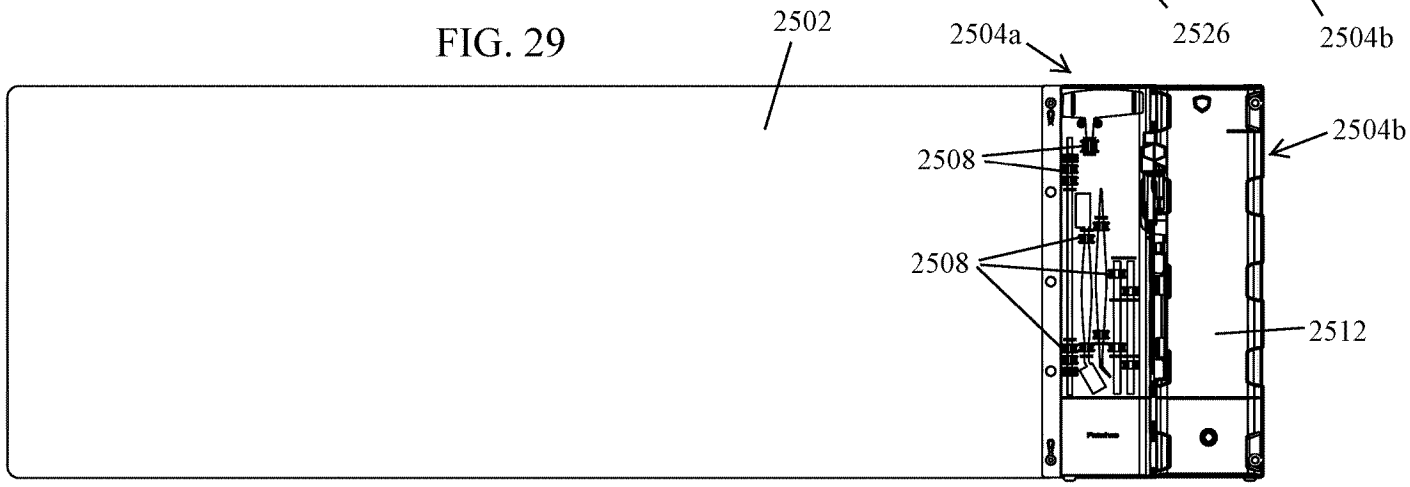
FIG. 29 is a top view of the firearm maintenance kit of FIG. 25 in an open configuration.
Figure 30:
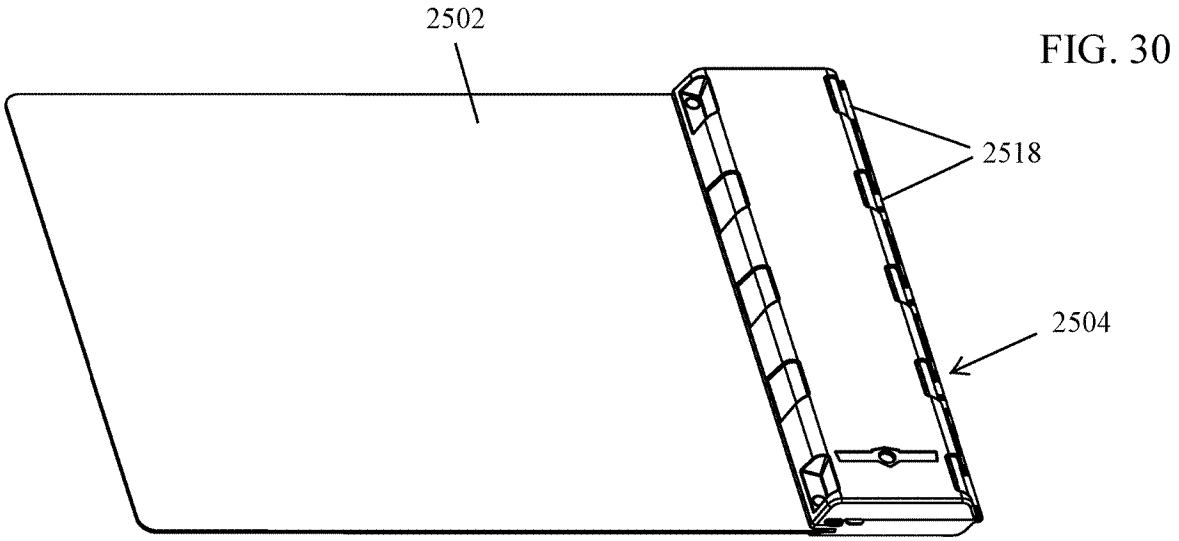
FIG. 30 is a top right perspective view of a slightly modified form of the firearm maintenance kit of FIG. 25 in a closed configuration.
Figure 31:
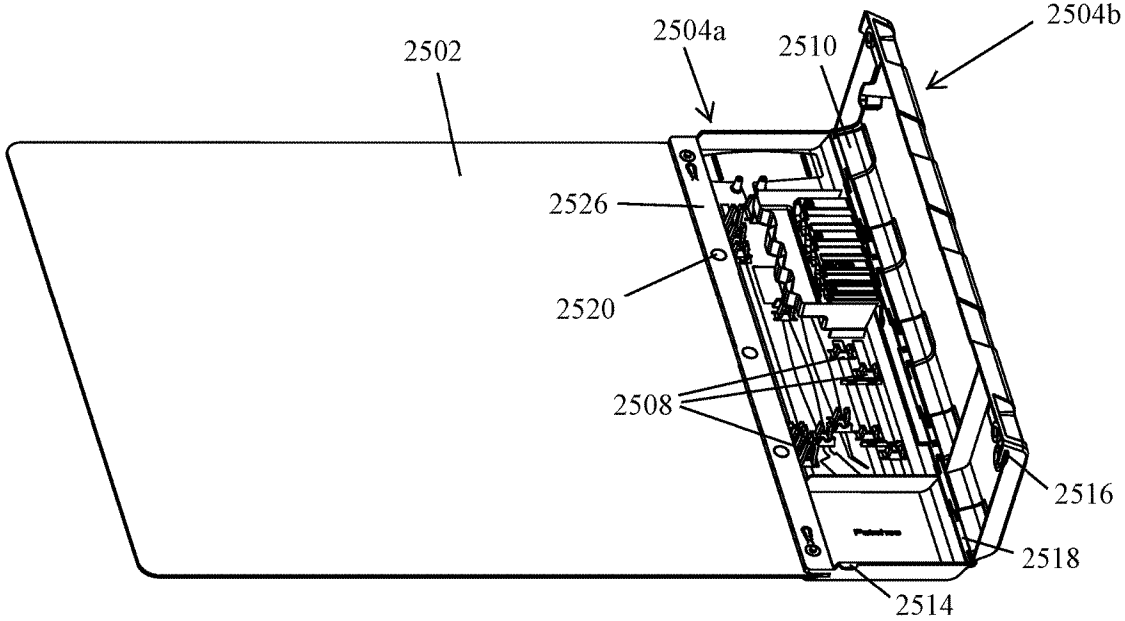
FIG. 31 is a top right perspective view of the firearm maintenance kit of FIG. 30 in a partially open configuration.
Figure 33:
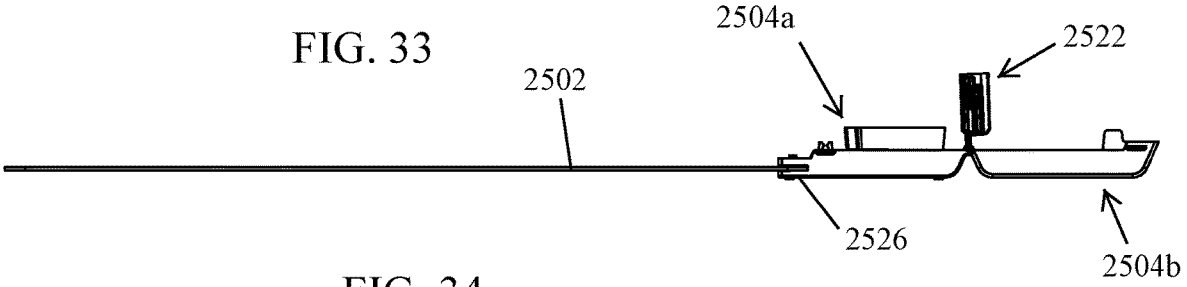
FIG. 33 is a right side view of the firearm maintenance kit of FIG. 30 in an open configuration; the left side view is a mirror image of the right side view.
Figure 34:
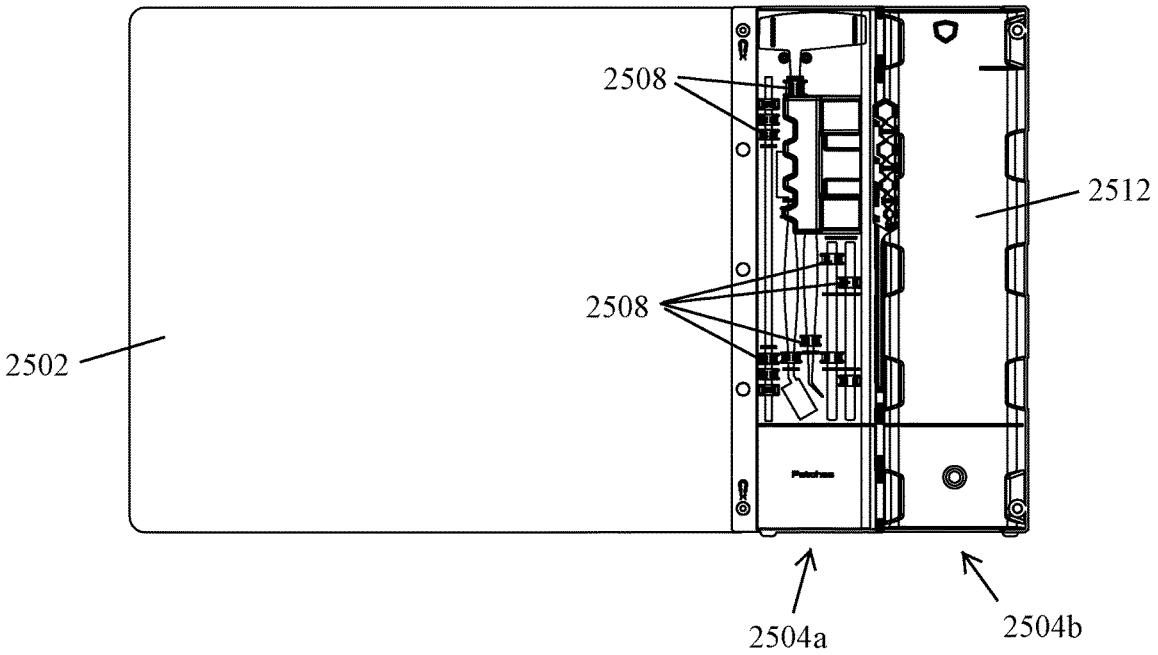
FIG. 34 is a top view of the firearm maintenance kit of FIG. 30 in an open configuration.
Figure 35:
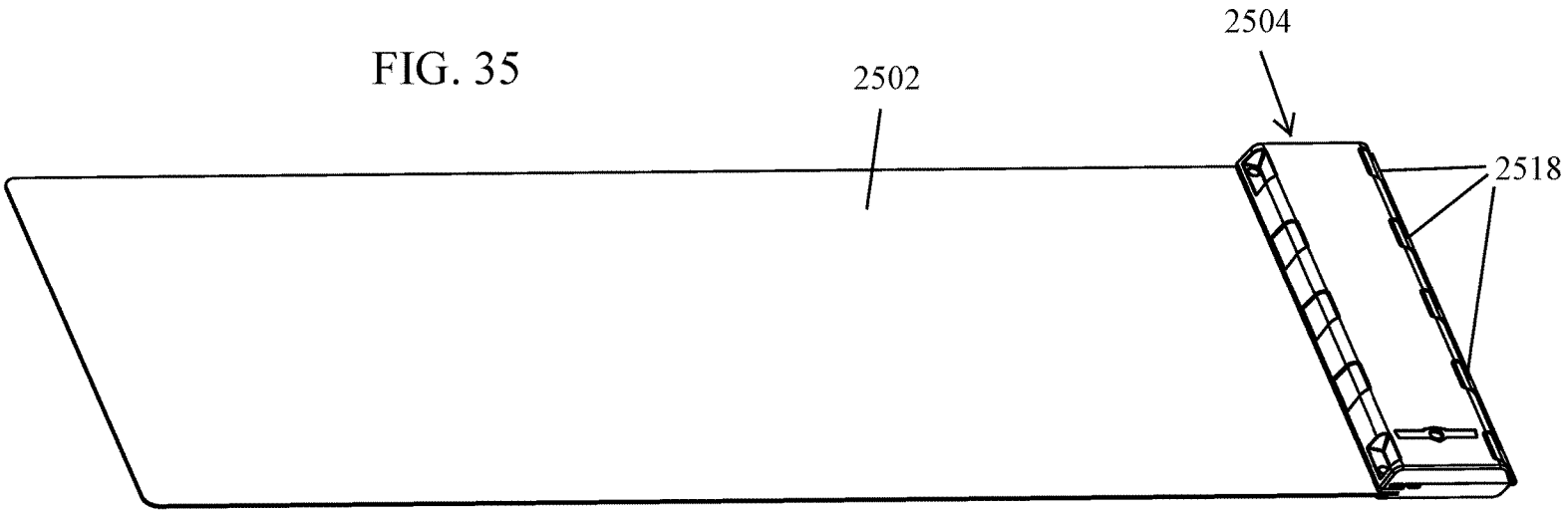
FIG. 35 is a top right perspective view of a slightly modified form of the firearm maintenance kit of FIG. 25 in a closed configuration.
Figure 36:
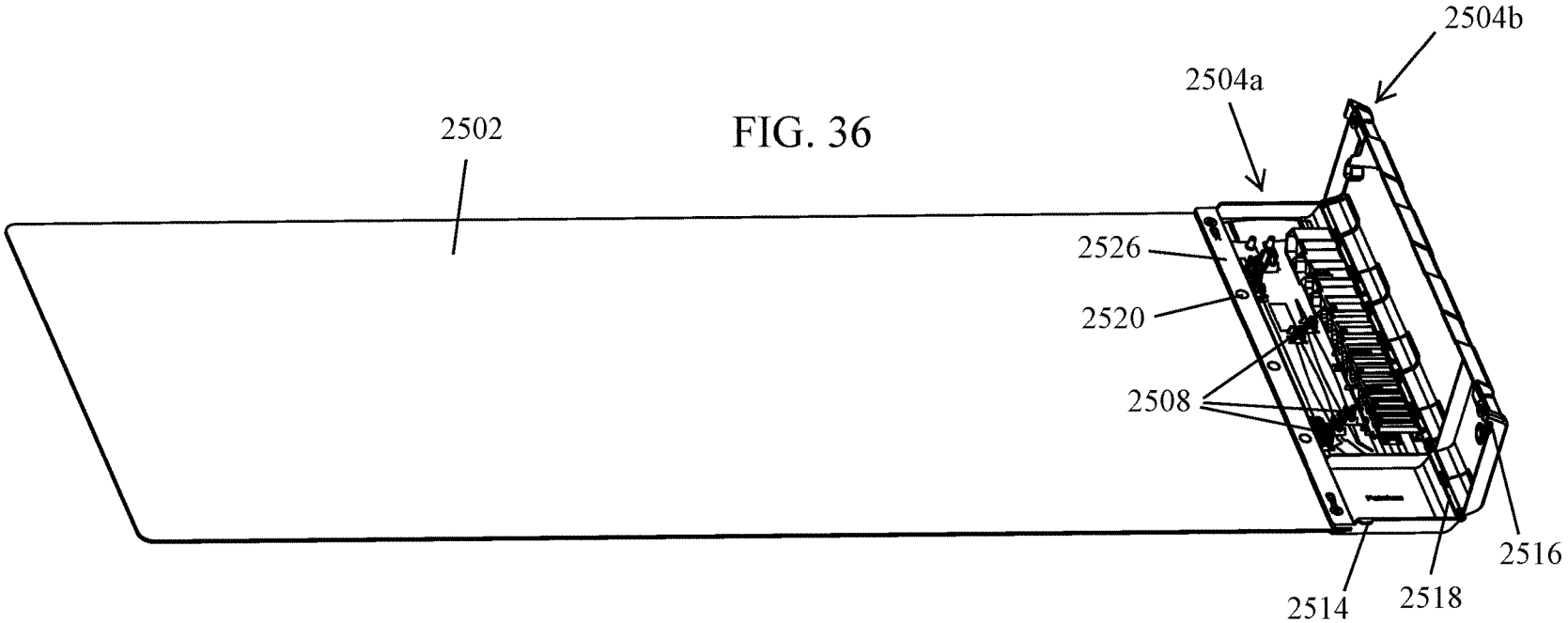
FIG. 36 is a top right perspective view of the firearm maintenance kit of FIG. 35 in a partially open configuration.
Figure 38:
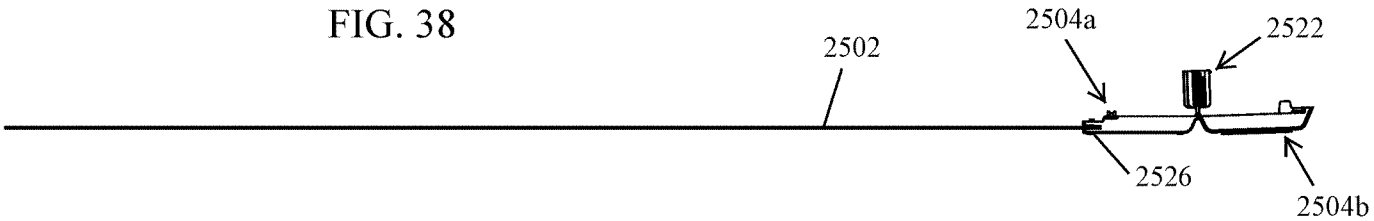
FIG. 38 is a right side view of the firearm maintenance kit of FIG. 35 in an open configuration; the left side view is a mirror image of the right side view.
Figure 39:
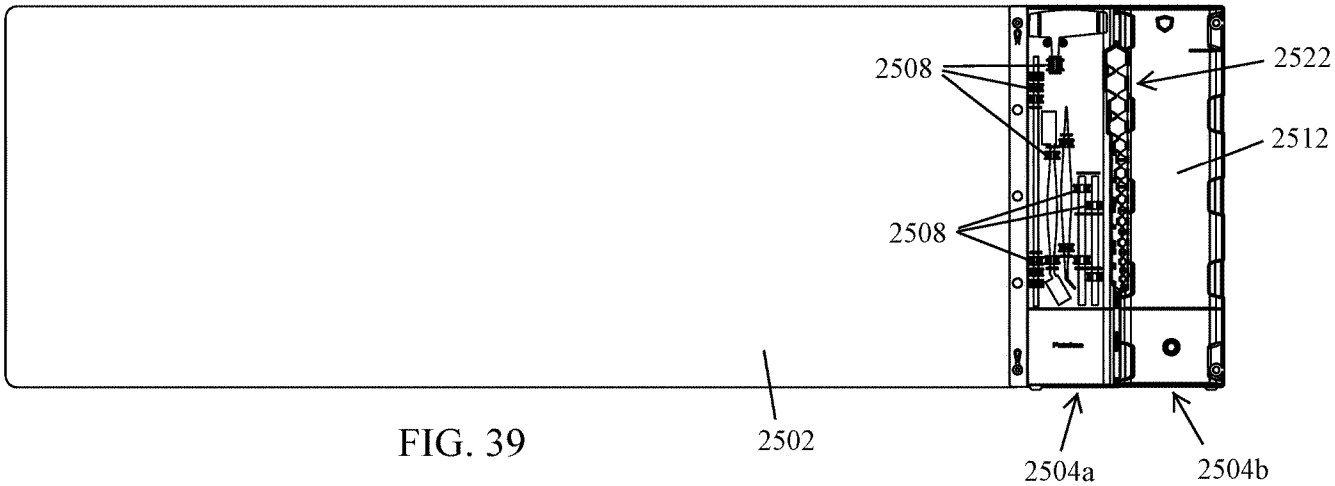
FIG. 39 is a top view of the firearm maintenance kit of FIG. 35 in an open configuration.

In one embodiment, pop-up insert 2522 can be permanently affixed between tray 2504*a* and cover 2504*b*. More specifically, pop-up insert 2522 can be affixed along at least a portion of one edge of tray 2504*a* via an inner portion of hinge 2518. This enables pop-up insert 2522 to rotate into an open, vertical position when small-parts storage tray 2504*a* transitions from a closed to an open position, as illustrated in the sequences of FIGS. 25-27, 30-32, and 35-37. Pop-up insert 2522 can be affixed and hinged longitudinally on an edge of tray 2504*a* that is opposite of flexible mat 2502, as illustrated in FIGS. 28, 33, and 38, but could also be affixed and hinged on any other edge of the tray.

To keep all tools, cleaning implements, and storage compartments separate and easy to access when the case is opened, the rotation of the insert may stop once the cover reaches a predetermined rotation angle (i.e., the open position of the pop-up insert may be described as a vertical position). Therefore, as cover 2504*b* is rotating open, pop-up insert 2522 can rotate with it. However, once pop-up insert 2522 rotates to a certain point (for example, once it reaches a perpendicular (i.e., 90-degree) angle to tray 2504*a*), cover 2504*b* can continue rotating, but the insert may stop rotating and may remain at its approximately 90-degree angle. Therefore, in a final, open position, tray compartments 2506 are exposed, the inner surface of top face 2512 is facing upward toward the user exposing any cover compartments 2506, and pop-up insert 2522 can be positioned upright in its vertical/perpendicular position.

When insert 2522 is in its vertical/perpendicular position, molded storage components 2524 and, therefore, any brushes, scrapers, field guides, and/or other cleaning tools secured thereto, can also be positioned in upright positions so that the tools are easy for a user to access. For example, if the insert includes storage components that are storing brushes, the handles of the brushes may protrude out from the molded storage components while the bristles are protected within the hollow cavity of the storage components.

In an example use case, a user can open a small-parts storage case, unroll the flexible mat that is affixed to the small-parts storage case, and remove any needed tools from the small-parts storage case to use during cleaning of the firearm. In some embodiments, as described above, the mat may be removably attached to the small-parts storage case (for example, through the rigid component of the mat attachment component). In other embodiments, the mat may be permanently attached to the small-parts storage case. In some cases, when the small-parts storage case is opened, an insert, such as a pop-up insert, can rotate into a vertical position. In some cases, when the small-parts storage case is opened, the cover may be completely removed from the tray and folded in half to create an independent storage case. As described above, the flexible mat may first need to be removed from the small-parts storage case before it can be unrolled. However, that is not required and, if the mat is not stored inside the small-parts storage case, it may be unrolled prior to opening the case.

When a user no longer needs to use the flexible mat or small-parts storage case, the user can roll the mat around the case and store the combined device in a bag or other standard storage device. In some cases, however, flexible mat 1202 can fit inside small-parts storage case 1204, as illustrated in FIGS. 16-19. For example, a user can roll up flexible mat 1202 and store it in case 1204 by rolling the far end of the mat that is not attached to the case toward the end of the mat attached to the case and, once the mat is fully rolled, inserting it into the case. In some embodiments, the flexible mat may not be permanently attached to the small-parts storage case and, therefore, either side of the mat can initiate the roll. In some embodiments, if the firearm maintenance kit has mat attachment component 1224 that snaps or slides into corresponding groove 1228 and functions like a hinge, mat 1202, once rolled-up, can rotate around this hinge until it is located inside small-parts storage case 1204.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the following claims.

What is claimed is:

1. A firearm maintenance kit comprising:

a mat structured and configured to roll up on itself; and a parts storage case having a mat attachment component comprising top and bottom faces, wherein the mat attachment component is structured and configured to clamp a first end of the mat between the top and bottom faces to affix the parts storage case to the mat, and wherein a top of the mat is in contact with the top face of the mat attachment component and a bottom of the mat is in contact with the bottom face of the mat attachment component when the mat is unrolled.

2. The firearm maintenance kit of claim 1, wherein the parts storage case comprises an open tray.

3. The firearm maintenance kit of claim 2, wherein the open tray is comprised of storage compartments.

4. The firearm maintenance kit of claim 1, wherein the parts storage case comprises a tray and a cover.

5. The firearm maintenance kit of claim 4, wherein the cover includes a mid-point hinge along which the cover is configured to fold in half.

6. The firearm maintenance kit of claim 4, wherein the tray and the cover are each comprised of a plurality of storage compartments.

7. The firearm maintenance kit of claim 4, wherein the tray and cover are attached to each other via a hinge.

8. The firearm maintenance kit of claim 7, wherein the mat is structured and configured to fit inside the parts storage case when rolled up.

9. The firearm maintenance kit of claim 8, wherein the mat attachment component is further comprised of a component located adjacent to the top and bottom faces.

10. The firearm maintenance kit of claim 9, wherein:

the parts storage case is further comprised of at least one groove defined by raised portions on an inside surface of the tray; and the component located adjacent to the top and bottom faces is a rounded protrusion that is structured and configured to fit into the at least one groove of the parts storage case and connects the parts storage case to the mat.

11. The firearm maintenance kit of claim 10, wherein the raised portions of the parts storage case include one or more tabs and the tabs:

protrude into the at least one groove from the raised portions;

are structured and configured to retain the component inside the at least one groove; and enable the component to rotate without separating from the at least one groove.

12. The firearm maintenance kit of claim 7, further comprising an insert stored within the parts storage case.

13. The firearm maintenance kit of claim 12, wherein:

the insert is a pop-up insert and is attached to the parts storage case between the tray and the cover;

the hinge has an inner portion contained between the tray and the cover; and the pop-up insert is attached to the inner portion of the hinge and rotates to a vertical position when the parts storage case transitions from a closed to an open position.

14. The firearm maintenance kit of claim 13, wherein the pop-up insert is comprised of hollow, molded storage components.

15. The firearm maintenance kit of claim 7, wherein the tray includes a plurality of friction fit tabs structured to hold tools in place.

* * * * *